US008723446B2

(12) United States Patent
Hoogzaad et al.

(10) Patent No.: US 8,723,446 B2
(45) Date of Patent: May 13, 2014

(54) METHOD AND CIRCUIT ARRANGEMENT FOR CYCLE-BY-CYCLE CONTROL OF A LED CURRENT FLOWING THROUGH A LED CIRCUIT ARRANGEMENT, AND ASSOCIATED CIRCUIT COMPOSITION AND LIGHTING SYSTEM

(75) Inventors: Gian Hoogzaad, Mook (NL); Wilhelmus H. M. Langeslag, Wijchen (NL); Frans Pansier, Nuenen (NL); Cheng Zhang, Nijmegen (NL)

(73) Assignee: NXP B.V., Eindhoven (NL)

( * ) Notice: Subject to any disclaimer, the term of this patent is extended or adjusted under 35 U.S.C. 154(b) by 851 days.

(21) Appl. No.: 12/992,091

(22) PCT Filed: May 6, 2009

(86) PCT No.: PCT/IB2009/051861

§ 371 (c)(1), (2), (4) Date: Nov. 11, 2010

(87) PCT Pub. No.: WO2009/138908

PCT Pub. Date: Nov. 19, 2009

(65) Prior Publication Data

US 2011/0068713 A1 Mar. 24, 2011

(30) Foreign Application Priority Data

May 13, 2008 (EP) ..... 08156072

(51) Int. Cl.
*H05B 37/02* (2006.01)

(52) U.S. Cl.
USPC ..... 315/307; 315/291; 315/224

(58) Field of Classification Search
USPC ..... 315/291, 307–311, 224, 225, 247, 246, 315/185 S
See application file for complete search history.

(56) References Cited

U.S. PATENT DOCUMENTS 6,153,985 A * 11/2000 Grossman ..... 315/291

(Continued)

FOREIGN PATENT DOCUMENTS

| | | | |
|---|---|---|---|
| WO | 2004/057924 | A1 | 7/2004 |
| WO | 2004/100614 | A1 | 11/2004 |
| WO | 2007/049198 | A | 5/2007 |

OTHER PUBLICATIONS

Anonymous "Driver for Supplying a Pulsating Current to Light Emitting Diodes," Research Disclosure, Mason Publications, Hampshire, GB, vol. 378, No. 14, 2 pgs. (Oct. 1995).

(Continued)

*Primary Examiner* — Jimmy Vu
*Assistant Examiner* — Amy Yang

(57) ABSTRACT

The invention provides a method for cycle-by-cycle control of a LED current (ILED) flowing through a LED circuit arrangement (LEDCIRC) at a mean LED current level. The method comprises a) establishing a converter current (IL), b) establishing an oscillation of the converter current (IL) between substantially a valley current level and substantially a peak current level, c) feeding the LED circuit arrangement (LEDCIRC) with the converter current (IL) as the LED current during a part of an oscillation cycle of the oscillation of the converter current, d) determining a current level correction for compensating a current level error between an integral over an oscillation cycle of the LED current and a reference, the reference being representative of the mean LED current level, and e) adjusting at least one of the valley current level and the peak current level with the current level correction for use in a successive cycle of the oscillation of the converter current. The invention also provides a circuit arrangement operable for using the method, a LED driver IC using the circuit arrangement, a circuit composition with at least one LED and the circuit arrangement, and a lighting system with the circuit composition.

18 Claims, 16 Drawing Sheets

(56) References Cited

U.S. PATENT DOCUMENTS

| | | | | |
|---|---|---|---|---|
| 7,276,861 | B1 * | 10/2007 | Shteynberg et al. | 315/291 |
| 7,511,436 | B2 * | 3/2009 | Xu | 315/307 |
| 8,258,719 | B2 * | 9/2012 | Hoogzaad | 315/291 |
| 2003/0117087 | A1 | 6/2003 | Barth et al. | |

OTHER PUBLICATIONS

Product Datasheet for UBA3070 LED Backlight Driver IC, NXP (Dec. 2, 2008).

International Search Report and Written Opinion for Int'l patent appln. No. PCT/IB2009/051861 (Oct. 28, 2009).

* cited by examiner

CC2
LEDCIRC1
LEDCIRC2
IC2
CIRC1
CIRC2
L1
IL1
L2
IL2
Vin
ILED1
ILED2
B1
B2
B3
B4
PWMCON1
PWMCON2
Led1
Led2
Led3
Led4
RS1
RS2
GND
uC2

5000
5001
5002
4000
5010
5011
5012

METHOD AND CIRCUIT ARRANGEMENT FOR CYCLE-BY-CYCLE CONTROL OF A LED CURRENT FLOWING THROUGH A LED CIRCUIT ARRANGEMENT, AND ASSOCIATED CIRCUIT COMPOSITION AND LIGHTING SYSTEM

FIELD OF THE INVENTION

The invention relates to a method for cycle-by-cycle control of a LED current flowing through a LED circuit arrangement at a mean LED current level. The invention further relates to a circuit arrangement for cycle-by-cycle control of a LED current flowing through a LED circuit arrangement at a mean LED current level. The invention further relates to a LED driver IC. The invention further relates to a circuit composition and to a LED lighting system.

BACKGROUND OF THE INVENTION

The light output of a light emitting diode is generally controlled by regulating a current level of a LED current through the LED. The LED current may be further modulated with, e.g. a pulse width modulation (PWM) scheme. In such a PWM-scheme, the LED receives the LED current in a periodic sequences of pulses of a certain width, while the width of the pulses is modulated from a first pulse width to a second pulse width when the effective light output is to be changed from a first light output level to a second light output level.

A LED drive method and a LED drive circuit thus generally comprise a current source, providing a constant current or an oscillating current with an average current level, and a switch associated with the LED in order to control a path of the current and in order to achieve the pulse width modulation of the LED current.

The switch may be in series with the LED, thus controlling the path of the current by interrupting the path of the current in order to achieve the pulse width modulation.

The switch may alternatively be in parallel with the LED, which will be referred to as a bypass switch. The bypass switch controls the path of the current by either guiding the path of the current through the LED or guiding the path of the current through a bypass path parallel to the LED in order to achieve the pulse width modulation. One of the advantages of such a bypass switch approach is that the current continues to flow, either through the LED or though the bypass path, which allows the use of very efficient current sources, such as a switch-mode current source. This is especially advantageous when a plurality of LEDs are to be operated at a common current level but with a possibly different pulse width between different LEDs from the plurality of LEDs. The LEDs may then be arranged in a plurality of LED segments connected in series, each LED segment comprising a single LED or two or more LEDs, the two or more LEDs preferably arranged in series, and each of the LED segments being associated with a bypass switch in parallel to the corresponding LED segment. By operating the bypass switches independently, the effective light output of each of the LED segments may be varied independently.

An example of a current source is described in WO 2004/100614A1. WO 2004/100614A1 describes a LED current control method and circuit for accurately and quickly regulating the mean amperage of LED current during all operating conditions including a change in the input line of a power source or in a change in a load of the LED network.

The method comprises controlling the LED current to oscillate, e.g. in a triangular or saw-tooth manner, between a peak amperage and a valley amperage, with the mean amperage being the average of the peak amperage and the valley amperage, by an alternate controlling of an increase and a decrease of the LED current in response to each crossover by a converter current sensing voltage of a lower trip voltage and an upper trip voltage in a negative and a positive direction respectively. A circuit using such a method may be referred to as an example of a switch-mode converter with hysteretic control on the LED current. The peak-to-valley range of the peak amperage to the valley amperage may be referred to as the hysteretic current window. The peak-to-valley range of the upper trip voltage to the lower trip voltage may be referred to as the hysteretic voltage window, or, in short, the hysteretic window.

The method and circuit thus achieve regulating the mean current level independent of the operating conditions. In particular, when the method and circuit are used to operate a LED circuit arrangement comprising a plurality of LED segments with corresponding bypass switches in an arrangement as described above. Operating the bypass switches to vary the light output of the individual LED segments results in a variation of the load of the LED circuit arrangement. The switch-mode converter with hysteretic control is well suited to accurately and quickly deliver a current with a substantially constant mean current level to such a LED circuit arrangement with varying load due to the operation of the bypass switches.

However, when increasing the switching frequency in a switch-mode converter like the hysteretic converter, the controlling of the increase and decrease of the current in response to a crossover of the converter current sensing voltage of the upper of lower trip voltage will not be perfect. The change of increasing to decreasing, or vice versa, may not be immediate, e.g. due to circuit delays, and may be associated with overshoots above the peak amperage and undershoots below the valley amperage. These over- and undershoots may e.g. find a cause in a relative increase of the effect of parasitic capacitance. Thus, although the oscillation is controlled to be within substantially the peak amperage and the valley amperage, this control is not perfect and inaccuracies occur. As a result, the achieved mean current level may deviated from the intended mean current level.

Hence, it is a problem of the known switch-mode converters that increasing the frequency is associated with an increased inaccuracy of the achieved mean current level. This hampers the increase of the frequency which is on the other hand preferred e.g. in order to reduce the total cost of the circuit, to reduce the size of inductors or capacitors, to reduce the required space of a LED driver circuit in a LED lighting system, to allow full integration of inductors and/or capacitors in a LED driver IC, and/or to obtain an improved response time, e.g. when dimming, e.g. due to a faster capacitive discharging.

SUMMARY OF THE INVENTION

The present invention aims to improve the accuracy of the switch mode converter. In particular, the present invention aims to improve the accuracy in achieving the mean LED current fed from a switch mode converter to a LED circuit arrangement.

For this purpose, the method according to the invention comprises:

establishing a converter current;

establishing an oscillation of the converter current between substantially a valley current level and substantially a peak current level;

feeding the LED circuit arrangement with the converter current as the LED current during a part of an oscillation cycle of the oscillation of the converter current;

determining a current level correction for compensating a current level error between an integral over an oscillation cycle of the LED current and a reference, the reference being representative of the mean LED current level;

adjusting at least one of the valley current level and the peak current level for use in a successive cycle of the oscillation of the converter current with the current level correction.

The method provides an improvement over prior-art switch-mode converters, as may, e.g. be applied for regulating the mean current level of the LED current with a Buck-converter with hysteretic control feeding a LED circuit arrangement of a plurality of LEDs in a series arrangement with bypass switches in parallel to each of the LEDs. The hysteretic control is applied on the converter current, being equivalent to the LED current for a Buck converter. For such a converter, the converter current behaves as a continuous, typically sawtooth-shaped current and the full converter current established in the converter is fed as the LED current to the LED circuit arrangement with the mean LED current level assumed to correspond to the arithmetic average of the peak current level and the valley current level. For other types of converters, such as for example a Buck-Boost converter, the LED current may be discontinuous even when the converter current is continuous: the hysteretic control may then be performed on the converter current, and part of the converter current will be fed to the LED circuit arrangement as the LED current. In the prior art, the mean LED current level is then typically assumed correspond to a weighted average of the peak current level and the valley current level with different weights for the peak current level and the valley current level, to take the effects of the partial feeding into account.

It should be remarked that the method according to the invention monitors and controls the converter current, whereas the method of WO 2004/100614A1 uses the LED current. These currents are the same for a Buck converter feeding a LED circuit arrangement of a series arrangement of a plurality of LEDs, but may be different for other types of converters, e.g. for a Buck-Boost converter which may be arranged, depending on its implementation, to feed the LED circuit arrangement only during the part of the converter current period during which the converter current is increasing or only during the part of the converter current period during which the converter current is decreasing. For those types of converters, hysteretic control is preferably performed on the converter current.

The switch-mode converter with hysteretic control may e.g. be of a so-called hysteretic Buck, hysteretic Buck-Boost or hysteretic Boost converter topology.

When the lower trip voltage level is zero and only the upper trip voltage level is adapted to achieve the required mean LED current level, the converter will be referred to in the following as a normal Buck, a normal Buck-Boost or a normal Boost converter topology.

When the lower trip voltage level is zero, a modified operation method is possible, which is generally referred to as a quasi-resonant converter or also as a boundary-conduction mode converter. Such a converter is described in e.g. WO 2007/049198. In such a quasi-resonant converter, the converter current is not immediately changed from decreasing to increasing when the converter current is decreased down to the lower trip level (zero). In stead, the converter current is allowed to resonate naturally based on the inductance and capacitance of the circuit. As described in WO 2007/049198, this allows zero-voltage switching in the switch mode converter, thus reducing switching losses. Quasi-resonant converters may be in e.g. a quasi-resonant Buck, quasi-resonant Boost or quasi-resonant Buck-Boost topology. Apart from the resonant phase, the method of operation of the quasi-resonant converter is very similar to that of the hysteretic and normal converters.

The invention is applicable to each of the described converter types, i.e. to hysteretic, normal and quasi-resonant Buck, Buck-Boost and Boost converter topologies, as well as to other similar topologies with a similar method of operation.

Whereas the prior art converters relate the mean LED current level to set-points of the controller, i.e. the valley current level and the peak current level in a feed-forward manner, e.g. by equating the mean LED current to the arithmetic average of the set-points, the method according to the invention adds a feed-back control. Moreover, the feed-back control is performed in a cycle-by-cycle manner aiming at achieving the required mean LED current level in the successive cycle of the oscillation of the converter current. Adding a classical feed-back loop as an outer control loop on top of the prior art converters would only achieve a slow convergence over typically more than 10 oscillation cycles towards a required level. By determining the current level correction for compensating the current level error between the integral over the oscillation cycle of the LED current and the reference, and adjusting at least one of the valley current level and the peak current level for use in the successive cycle of the oscillation of the converter current with the current level correction, the method achieves a fast and accurate control. The current level correction may be determined from the current level error from a single oscillation cycle, or take into account also earlier oscillation cycles.

Further embodiments of the method according to the invention may be directly concluded from the embodiments of the circuit arrangements according to the invention described below.

The circuit arrangement according to the invention provides a circuit arrangement arranged for:

establishing a converter current;

establishing an oscillation of the converter current between substantially a valley current level and substantially a peak current level;

feeding the LED circuit arrangement with the converter current as the LED current during a part of an oscillation cycle of the oscillation of the converter current;

determining a current level correction for compensating a current level error between an integral over an oscillation cycle of the LED current and a reference, the reference being representative of the mean LED current level; and adjusting at least one of the valley current level and the peak current level with the current level correction for use in a successive cycle of the oscillation of the converter current.

The circuit arrangement may, during use, be in electrical connection to a LED circuit arrangement and may cooperate with the LED circuit arrangement. The LED circuit arrangement may alternatively be included in the circuit arrangement. Embodiments of the circuit arrangement are described below.

The circuit arrangement may thus perform, during use, the method described above.

In an embodiment of the circuit arrangement according to the invention:

for establishing the oscillation of the converter current, the circuit arrangement comprises:

a converter current sensor operable to establish a converter current sensing signal representative of the current level of the converter current flowing in the circuit arrangement, a hysteretic comparator operable to establish an upper trip signal and a lower trip signal as control crossover thresholds, the upper trip signal being associated with the peak current level of the converter current and the lower trip signal being associated with the valley current level of the converter current, the hysteretic comparator being in electrical communication with the converter current sensor to receive the converter current sensing signal, wherein the hysteretic comparator is operable to output a switching control signal at a first logic level in response to a crossover of the lower trip signal by the converter current sensing signal, and wherein the hysteretic comparator is operable to output the switching control signal at a second logic level in response to a crossover of the upper trip signal by the converter current sensing signal, and;

a switch-mode converter operable to control a flow of the converter current through the circuit arrangement, the switch-mode converter being in electrical communication with the hysteretic comparator to receive the switching control signal, wherein the switch-mode converter controls an increase of the converter current from the valley current level to the peak current level in response to the switching control signal equaling the first logic level, and wherein the switch-mode converter controls a decrease of the converter current from the peak current level to the valley current level in response to the switching control signal equaling the second logic level;

for determining the current level correction for compensating the current level error between the integral over the oscillation cycle of the LED current and the reference, the circuit arrangement comprises:

a correction calculator operable for determining the current level correction, the correction calculator being in electrical communication with the converter current sensor to receive the converter current sensing signal;

for adjusting at least one of the valley current level and the peak current level with the current level correction for use in the next cycle of the oscillation of the converter current, the circuit arrangement comprises:

a threshold controller operable for adjusting at least one of the upper trip signal and the lower trip signal, corresponding with adjusting the valley current level and the peak current level respectively, the threshold controller being in electrical communication with the correction calculator for receiving the current level correction and in electrical communication with the hysteretic comparator for delivering, after adjusting, the upper trip signal and the lower trip signal respectively.

The upper trip signal and the lower trip signal are preferably voltage signals, but could also be current signals. The switching control signal is preferably a voltage signal, and may then be referred to as the switching control voltage.

The method controls the mean LED current level by controlling the converter current to oscillate between a peak current level and a valley current level in response to a crossover by the converter current of the lower trip current level and the upper trip current level in the negative and the positive direction respectively. Note that a quasi-resonant converter will not immediately change the direction in which the current changes in response to a crossover by the converter current of the lower trip current level in the negative direction, but will first allow the current to oscillate, typically substantially back to the lower trip current level, before actively controlling an increase of the converter current.

The invention provides a new inventive aspect to the switch-mode converter in providing additionally a fast control of the mean LED current level by determining the current level correction and adjusting at least one of the upper trip signal and the lower trip signal.

In case of a hysteretic converter, both the upper as well as the lower trip signals may be adjusted. The threshold controller may directly determine the adjusted levels of the upper and lower trip signals, or determine an adjusted reference level, associated with the average of the upper trip signal and the lower trip signal, and optionally an adjusted hysteretic window. The hysteretic comparator may then derive the upper and lower trip signal, e.g. current level, from the adjusted reference level and the adjusted hysteretic window.

In case of a normal or quasi-resonant converter, wherein the lower trip signal is zero, only the upper trip signal is adjusted.

The current level of the converter current is represented by the converter current sensing signal, which may be a voltage signal, allowing an easier electrical signal manipulation and signal processing than a current signal. The voltage signal, further referred to as the converter current sensing voltage, may, e.g. be the voltage over a resistor in the path of the converter current. The converter current sensor may comprise a resistor in the current path of the converter current and a voltage measurement unit arranged to measure the voltage over the resistor and to provide the measured voltage as the converter current sensing voltage. The converter current sensor may alternatively cooperate with a resistor in the current path of the converter current and comprise a voltage measurement unit arranged to measure the voltage over the resistor and to provide the measured voltage as the converter current sensing voltage. The resistor may be a resistor external to the circuit arrangement but connected to the circuit arrangement. E.g. when the circuit arrangement is an integrated circuit, the resistor may be connected to the IC, and the IC may comprise the voltage meter to measure the voltage over the resistor. When referring to manipulation, such as integration, of the converter current in the following, the reference may refer to the converter current itself or to a current derived from the converter current sensing signal, e.g. a current established from a programmable current source, programmed with the level of the converter current sensing signal and scaled to an appropriate level, e.g. the convert current level.

The hysteretic comparator typically comprises a comparator having an inverting input and a non-inverting input, wherein the converter current sensing voltage is applied to the inverting input of the comparator, and the hysteretic comparator comprises a multiplexer, the multiplexer being operable to provide the upper trip voltage and the lower trip voltage time-sequentially as a trip voltage to the non-inverting input of the comparator.

The comparator thus is operable to compare the converter current sensing voltage to either the upper trip voltage or the lower trip voltage, to output the switching control voltage at the first logic level in response to a crossover of the lower trip voltage by the converter current sensing voltage, and to output the switching control voltage at the second logic level in response to a crossover of the upper trip voltage by the converter current sensing voltage.

In a further embodiment of the circuit arrangement, the correction calculator comprises:

an integration current establisher operable for establishing an integration current, the integration current being representative of the LED current, the integration current establisher being in electrical communication with the converter current sensor for receiving the converter current sensing signal;

a first current integrator operable for obtaining an actual current integral from:

receiving the integration current from the integration current establisher, and integrating the integration current over the part of the oscillation cycle as the actual current integral;

a reference current establisher operable for establishing a reference current with a reference current level representative of the mean LED current level; and a second current integrator operable for obtaining a reference current integral from:

receiving the reference current from the reference current establisher, and integrating the reference current over the oscillation cycle as the reference current integral;

and wherein the correction calculator is operable for determining the current level correction from at least the actual current integral and the reference current integral.

The correction calculator may thus obtain the current level correction from an integration over exactly one oscillation cycle of the integration current, representative of the LED current, and the reference current, representative of the mean LED current level.

An advantage of obtaining the reference from an integration of the reference current is that such integration automatically incorporates the effects of a change of the length of the oscillation period. When, for example, the load of the LED circuit arrangement varies due to a change in condition of the bypass switches, the method of operation of the switch-mode controller generally results in a change of the length of the oscillation period.

When the circuit arrangement and the LED circuit arrangement are operated such that the oscillation period has a fixed duration, the second current integrator may use a constant value for the reference current integral. The constant value may be a per-determined value, e.g. pre-loaded into a register of the circuit arrangement or determined from e.g. an externally connected resistor with a resistor value indicative of the reference current integral, or e.g. be determined once from an integration of the reference current and then stored as e.g. constant register value for later retrieval, or determined every time the circuit arrangement is powered up.

In a further embodiment of the circuit arrangement, the correction calculator is operable for determining a multiplicative correction factor from dividing the reference current integral by at least the actual current integral, and the threshold controller is operable for adjusting at least one of the valley current level and the peak current level by multiplying with the multiplicative correction factor.

E.g., as an example, denoting the reference current integral for the N-th oscillation cycle with Int(Iref(N)) the actual current integral for the N-th oscillation cycle with Int(Iconverter(N)), the peak current level for the N-th oscillation cycle with Ipeak(N) and having a valley current level of 0 in a (normal, hysteretic or quasi-resonant) Buck-converter, the adjusted peak current level for the (N+1)-th oscillation cycle Ipeak(N+1) is determined as:

$$Ipeak(N+1)=Ipeak(N)*Int(Iref(N))/int(Iconverter(N)),$$

wherein Int(Iref(N))/int(Iconverter(N)) is the multiplicative correction factor.

In an alternative further embodiment of the circuit arrangement, the correction calculator is operable for determining an additive correction term from:

obtaining a difference of the reference current integral and the actual current integral by subtracting the actual current integral from the reference current integral, and dividing the difference by at least a time duration of the oscillation cycle, and the threshold controller comprises is operable for adjusting at least one of the valley current level and the peak current level by adding the additive correction term.

E.g., as an example, denoting the reference current integral for the N-th oscillation cycle with Int(Iref(N)) the actual current integral for the N-th oscillation cycle with Int(Iconverter(N)), the peak current level for the N-th oscillation cycle with Ipeak(N), the time duration of the oscillation cycle of the N-th oscillation cycle with T(N) and having a fixed valley current level in a (normal, hysteretic or quasi-resonant) Buck-converter, the adjusted peak current level for the (N+1)-th oscillation cycle Ipeak(N+1) may be determined as:

$$Ipeak(N+1)=Ipeak(N)+2*(Int(Iref(N))-int(Iconverter(N)))/T(N),$$

wherein 2*(Int(Iref(N))−int(Iconverter(N)))/T(N) is the additive correction term.

When the converter current is only feeding the LED circuit arrangement during a part of the oscillation period, the part having a relative duration denoted with a duty cycle being smaller than 100%, as in a (normal, hysteretic or quasi-resonant) Buck-Boost (in boost mode) or Boost converter, the adjusted peak current level for the (N+1)-th oscillation cycle Ipeak(N+1) may be determined as:

$$Ipeak(N+1)=Ipeak(N)+2*(Int(Iref(N))-int(ILED(N)))/(T(N)),$$

wherein int(ILED(N)) denotes the integral of the LED current over the oscillation period, i.e. ILED(N) is related to the converter current as ILED(N)=Iconverter(N) during the part of the oscillation period in which the converter is feeding the LED circuit arrangement, and ILED(N)=0, during the rest of the oscillation period.

In an embodiment of the circuit arrangement, the correction calculator comprises:

a reference current establisher operable for establishing a reference current with a reference current level representative of the mean LED current level;

an integration current establisher operable for establishing an integration current, the integration current being representative of the LED current, the integration current establisher being in electrical communication with the converter current sensor for receiving the converter current sensing signal;

and the correction calculator is operable for:

receiving the reference current from the reference current establisher;

receiving the integration current from the integration current establisher;

obtaining a current difference of the integration current and the reference current by subtracting the integration current from the reference current during the oscillation cycle;

integrating the current difference over the oscillation cycle to obtain the current level error; and determining the current level correction from at least the current level error.

An advantage compared to the embodiment above is that only a single integration is needed, as the currents are first subtracted to obtain the current difference and the current difference is then integrated.

In a further embodiment of the circuit arrangement, the correction calculator is operable for determining an additive correction term from dividing the current level error by at least a time duration of the oscillation cycle and the threshold controller is operable for adjusting at least one of the valley current level and the peak current level by adding the additive correction term.

E.g., as an example, denoting the reference current for the N-th oscillation cycle with Iref(N), the actual current for the N-th oscillation cycle with Iconverter(N), the peak current level for the N-th oscillation cycle with Ipeak(N), the time duration of the oscillation cycle of the N-th oscillation cycle with T(N) and having a fixed valley current level in a (normal, hysteretic or quasi-resonant) Buck-converter, and "int" to denote the integral over an oscillation cycle, the adjusted peak current level for the (N+1)-th oscillation cycle Ipeak(N+1) may be determined as:

$$Ipeak(N+1)=Ipeak(N)+2*Int(Iref(N)-Iconverter(N))/T(N),$$

wherein Iref(N)−Iconverter(N) is the current difference, and Int(Iref(N)−Iconverter(N))/T(N) is the current level error.

In an embodiment of the circuit arrangement, the circuit arrangement further comprises:

a constant current establisher operable for establishing a constant current with a constant current level;

a constant current integrator operable for obtaining the time duration of the oscillation cycle from:

receiving the constant current, integrating the constant current over the part of the oscillation cycle as an integrated constant current, and normalizing the integrated constant current with the constant current level.

By integrating a constant current with a known constant current level from a start moment to a stop moment, and normalizing the integral with the constant current level, a time duration from the start moment to the stop moment is obtained. When, e.g., determining the start moment from an instance in time at which a valley current level is detected, corresponding to the start of the N-th oscillation period, and determining the stop moment from a first successive instance in time at which the valley current level is detected again, corresponding to the end of the N-th oscillation period, the time duration of the N-th oscillation period may be determined.

This allows for a robust method to obtain the time duration of the oscillation cycle without the need for a high-speed digital timer or another type of time counter.

Note that the detection of the valley current level may already be performed by the switch-mode converter in determining when the direction of change of the converter current has to occur. The start and stop moments may thus also be obtained from e.g. successive positive slope of the switching control signal.

In an embodiment of the circuit arrangement, for integrating a specific current for obtaining a specific current integral over a fraction of the oscillation cycle, the circuit arrangement comprises:

a first reset circuit operable for:

resetting a first accumulator;

the first accumulator being operable for:

accumulating an integration current representative of the specific current over the fraction of the oscillation cycle on the first accumulator as a first accumulated integration current, and for providing the first accumulated integration current from the first accumulator as the specific current integral after the fraction of the oscillation cycle has lapsed.

The specific current may be e.g. any one of the converter current, the LED current, the integration current, the reference current, the current difference and the constant current. The specific current integral may be any one of the corresponding integrals as described above. The fraction may be e.g. the part of the oscillation cycle or the oscillation cycle.

The accumulator may be a capacitor or an array of capacitors. Resetting the accumulator may correspond to discharging the capacitor, e.g. switch the capacitor to ground with a reset switch parallel to the capacitor. Starting and stopping the accumulation may be performed using a switch in series to the capacitor.

Integration is thus performed in an analogue way, starting from a reset at the start moment of integration, and providing the integration results after the stop moment.

The integration result may be stored in a sample and hold circuit, which may e.g. comprise a sample-and-hold capacitor and a sample-and-hold switch, the sample-and-hold switch being arranged in a series arrangement between the first accumulator and the sample-and-hold capacitor, and arranged to load the accumulated current on the sample-and-hold capacitor when closing the sample-and-hold switch, and to hold the accumulated current on the sample-and-hold capacitor by opening the sample-and-hold switch. Note that we use the term "a closed switch" when the switch is in a state to conduct a current from one terminal to the other, and "an open switch" when the switch is in a state to prevent a current to flow from one terminal to the other.

In a further embodiment of the circuit arrangement, the circuit arrangement further comprises:

a second reset circuit operable for:

resetting a second accumulator while the integration current is accumulated on the first accumulator in a first oscillation cycle;

the second accumulator being operable for:

accumulating the integration current representative of the specific current over the fraction of the oscillation cycle in a second oscillation cycle on the second accumulator as a second accumulated integration current, the second oscillation cycle being successive to the first oscillation cycle, while the first accumulator is providing the accumulated integration current from the first accumulator as the specific current integral;

providing the second accumulated integration current as the specific current integral after the fraction of the second oscillation cycle has lapsed.

As some components or circuit parts of the circuit arrangement may introduce delays, a non-zero time may be required for resetting of an accumulator, e.g. discharging a capacitor, and/or a non-zero time may be required to provide the integration result to e.g. a sample-and-hold circuit, a single reset-accumulator may have the risk of introducing inaccuracies due to e.g. offsets from some charge that is still present or an inaccurate transfer of the result.

Using two accumulators allows to accurately integrate on one accumulator while the other accumulator is providing the preceding integration result during a non-zero fraction of the oscillation cycle and while the other accumulator is being reset during another non-zero fraction of the oscillation cycle.

This way, sufficient time is available, for accurate retrieving of the integration result and for a complete resetting of the accumulators before integrating.

In a further embodiment of the circuit arrangement, the first reset circuit and the second reset circuit are implemented with at least a common reset switch.

While switching the accumulation from the first accumulator to the second, the reset switch is then switched to operate from the second to the first accumulator.

In an embodiment of the circuit arrangement, the switch-mode converter comprises:

a switch in electrical communication with the hysteretic comparator to be opened and closed as a function of the switching control signal, a component selected from the group consisting of a diode and a second switch, the second switch being in electrical communication with the hysteretic comparator to be closed and opened as a function of the switching control signal, the component being in electrical communication with the switch via an output node, the output node being, during use, in electrical communication with the LED circuit arrangement, and the switch being arranged for charging and discharging an inductive output filter, the inductive output filter being, during use, in electrical communication with the LED circuit arrangement.

The switch-mode converter is thus operable to control the increase of the converter current from the valley current level to the peak current level in response to the switching control voltage equaling the first logic level, and operable to control the decrease of the converter current from the peak current level to the valley current level in response to the switching control voltage equaling the second logic. In case of a boundary-conduction mode arrangement, the switch-mode converter is further operable to control the resonating of the converter current when the converter current has decreased to the valley current level, e.g. postponing the operation of the switch that is going to charge the inductor until a zero or minimal voltage is obtained over the switch.

The inductive output filter may be comprised in the switch-mode converter, or alternatively be externally connected to the switch-mode converter or the circuit arrangement.

With the switch and the component selected from the group consisting of a diode and a second switch, a so-called half-bridge structure may be constructed allowing to switch the output node between an upper and a lower supply voltage.

The circuit arrangement may further comprise:

a power supply operable to deliver an input supply voltage, the power supply being in electrical communication with the switch-mode converter to supply the switch-mode converter with the input supply voltage, and a capacitive input filter in electrical communication with the power supply.

The capacitive input filter is usually applied to reduce sensitivity to variations in the supply voltage, in particular to reduce the sensitivity to disturbances on the supply voltage. Usually with prior-art hysteretic control, a strong filtering is required with a large capacitor, because at the lower conversion frequencies input current is drawn from the input capacitor for a relatively long duration. With the invention, which allows for higher conversion frequencies, a less strong filtering can be accepted, and a smaller capacitor can be applied, which may be attractive because of cost considerations.

In an embodiment of the circuit arrangement, the converter current sensor is arranged to determine the converter current sensing signal from a voltage drop over a resistor, the resistor being arranged to transmit the converter current flowing through the circuit arrangement.

The resistor can be outside or inside the circuit arrangement. In particular, when the circuit arrangement is integrated in an integrated circuit, the resistor is preferably outside the circuit arrangement.

In a further embodiment, the circuit arrangement comprises the resistor and the resistor is in electrical communication with the LED circuit arrangement and with the converter current sensor.

In an embodiment of the circuit arrangement, the circuit arrangement further comprises:

a LED segment controller in electrical communication with the LED circuit arrangement, and wherein the LED circuit arrangement comprises a first LED segment, a first switching element electrically parallel to the first LED segment, at least a second LED segment, a second switching element electrically parallel to the second LED segment, the first and second switching elements being operable by the LED segment controller to select the path of the LED current to pass through the LED segment associated with the respective switching element or to bypass the LED segment associated with the respective switching element.

When the first switching element is open, the current will flow through the first LED segment. When the first switching element is closed, the current will flow through the first switching element and bypass the first LED segment.

When the second switching element is open, the current will flow through the second LED segment. When the second switching element is closed, the current will flow through the second switching element and bypass the second LED segment.

By operating the first and second switching elements, the path of the LED current is thus selected to pass selectively through the LED segments.

Controlling the path of the LED current flowing through the LED circuit arrangement by operating the first and the second switching element for controlling the path of the current through the first and the second LED segments is associated with varying the effective light output of the corresponding LED segments. The first and second switches may e.g. be controlled in a pulse width modulation fashion.

The LED driver IC according to the invention comprises one of the circuit arrangements described above.

The LED driver IC may include one or more of the above-mentioned components like inductors, capacitors and/or resistors, but these components may also be external to the IC, and connected to the IC during use to cooperate with the IC. The composition of the external components and the IC may then together form a complete circuit arrangement according to the invention.

In further embodiments, the LED driver IC comprising at least one further circuit arrangement, each of the circuit arrangement and the at least one further circuit arrangements being associated with, during use, feeding a corresponding LED circuit arrangement.

The circuit arrangement and the at least one further circuit arrangements may be of the same types, or of different types. E.g., the circuit arrangement may be a hysteretic Buck converter and the at least one further circuit arrangement may be a hysteretic Buck-Boost converter.

In embodiments, the LED driver IC according to the invention comprises a plurality of any one or more of the circuit arrangements described above, each of the plurality of circuit arrangements being associated with a corresponding LED circuit arrangement.

The LED driver IC according to the invention comprises a first circuit arrangement according to one of the embodiments described above, associated, during use, with a first LED circuit arrangement.

The LED driver IC may include one or more of the above-mentioned components like inductors, capacitors and/or resistors, but these components may also be external to the IC, and connected to the IC during use to cooperate with the IC. The composition of the external components and the IC may then together form a complete circuit arrangement according to the invention.

In further embodiments, the LED driver IC further comprises a second circuit arrangement according to one of the embodiments described above, associated, during use, with a second LED circuit arrangement.

The first circuit arrangement and the second circuit arrangements may be of the same types, or of different types. E.g., the first circuit arrangement may be a hysteretic Buck converter and the second circuit arrangement may be a hysteretic Buck-Boost converter.

The invention further provides a circuit composition comprising:

a circuit arrangement, as described above, and a LED circuit arrangement including at least one LED, wherein the circuit arrangement is in electrical communication with the LED circuit arrangement for feeding the converter current to the LED circuit arrangement during the part of the oscillation cycle of the oscillation of the converter current.

The circuit arrangement may be comprised in a LED driver IC as described above.

The invention further provides a LED lighting system comprising a LED circuit arrangement comprising at least one LED and one of the circuit arrangements described above.

The LED lighting system may comprise any one of the circuit compositions described above.

The LED lighting system may be a brightness controlled LED-lamp, a color-variable LED lamp, a LED matrix light source, a LED matrix display, a large-sized LED information display for advertisement or moving images, a LED-backlight for a LCD-TV, a LED-backlight for a LCD-monitor, or any other lighting system in which LED current through at least one LED may be regulated in accordance with aspects of the present invention as described above.

BRIEF DESCRIPTION OF DRAWINGS

The above and other aspects of the invention will be further elucidated and described in detail with reference to the drawings, in which corresponding reference symbols indicate corresponding parts.

DETAILED DESCRIPTION OF THE EMBODIMENTS

Figure 1A:
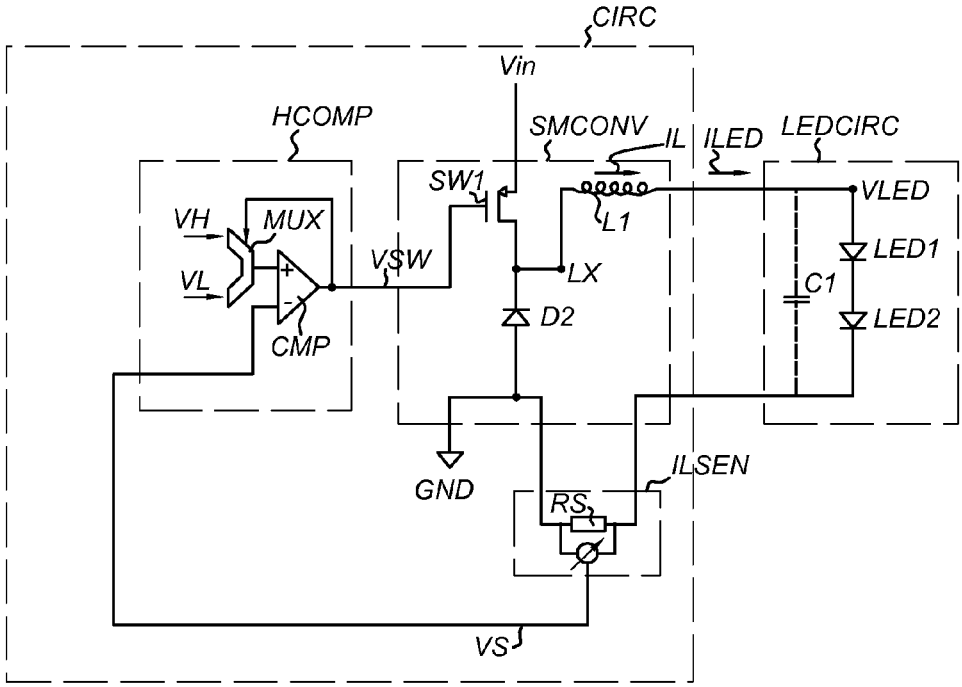
Fig 1a Prior Art
FIG. 1*a* schematically shows a circuit arrangement according to the prior art, supplying a current to a fixed LED arrangement.
Figure 1B:
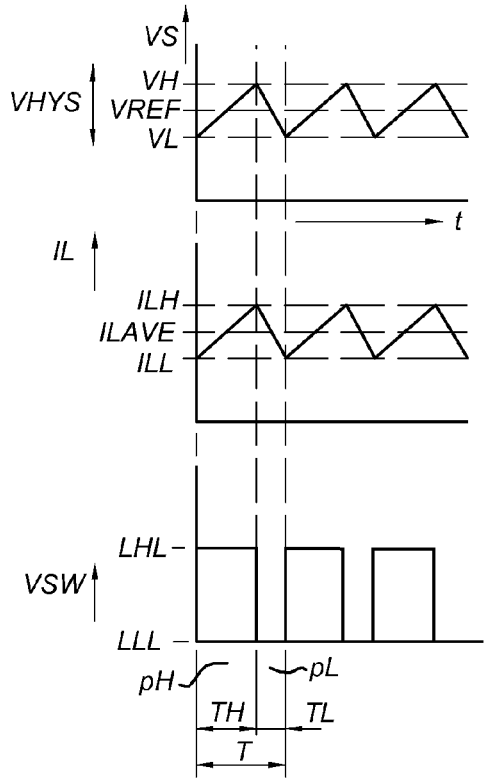
FIG. 1*b*-1*d* shows electrical signals related to the circuit arrangement of FIG. 1*a* when operated as a hysteretic Buck configuration, a normal Buck configuration and a boundary-conduction mode Buck configuration respectively.
Figure 1C:
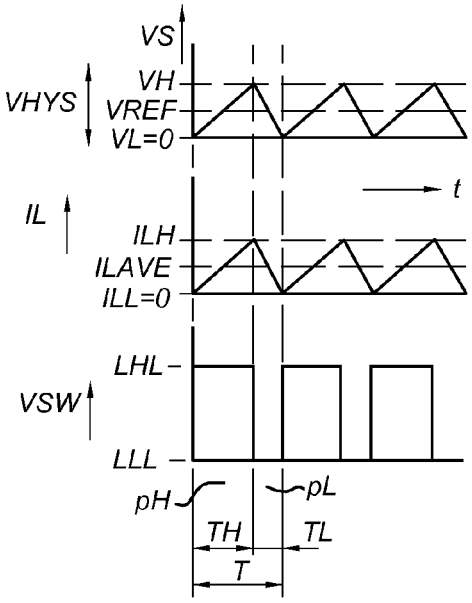
Figure 1D:
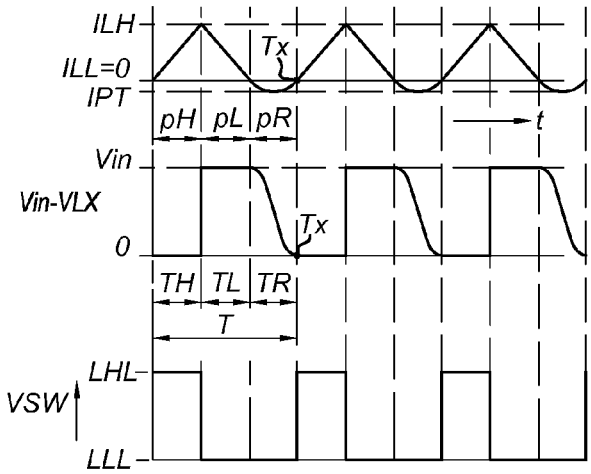

FIG. 1*a* schematically shows a circuit arrangement CIRC according to the prior art, supplying a current to a fixed LED arrangement LEDCIRC. FIG. 1*b* shows electrical signals related to the circuit arrangement CIRC shown in FIG. 1*a* when operated as a hysteretic Buck-converter; FIG. 1*c* shows electrical signals related to the circuit arrangement CIRC shown in FIG. 1*a* when operated as a normal Buck-converter; FIG. 1*d* shows electrical signals related to the circuit arrangement CIRC shown in FIG. 1*a* when operated as a boundary-conduction mode Buck-converter.

The circuit arrangement CIRC is arranged for regulating a mean current level of a LED current ILED flowing through a LED arrangement LEDCIRC. In the example shown, the LED arrangement LEDCIRC is a series arrangement of a first light emitting diode LED1 and a second light emitting diode LED2. The LED arrangement may further comprise an optional capacitive filter C1 to smoothen the current through the LEDs LED1, LED2. The example shown uses a so-called Buck-converter, in which the full converter current IL flowing through the circuit arrangement is fed to the LED circuit arrangement as the LED current ILED.

The circuit arrangement has a converter current sensor ILSEN. The converter current sensor includes a sense resistor RS, which is arranged to conduct the converter current IS. The voltage drop over the sense resistor RS is representative of the current level of the converter current IL. The voltage drop will be further referred to as the converter current sensing voltage VS.

The circuit arrangement further comprises a hysteretic comparator HCOMP and a switch-mode converter SMCONV. The hysteretic comparator HCOMP is arranged to establish an upper trip voltage VH and a lower trip voltage VL as control crossover thresholds. The upper trip voltage VH is associated with a peak current level ILH of the converter current IL and the lower trip voltage VL is associated with a valley current level ILL of the converter current IL. The mean current level ILAVE is an average of the peak current level ILH and the valley current level of the converter current ILL. The hysteretic comparator HCOMP is in electrical communication with the converter current sensor ILSEN to receive the converter current sensing voltage VS.

When the converter has a so-called hysteretic Buck-converter topology, both trip voltages VH, VL are generally non-zero; when a so-called normal Buck-converter, the lower trip voltage VL is zero and the upper trip voltage is non-zero; when the converter has a so-called boundary conduction mode Buck converter, also called a quasi-resonant Buck-converter the lower trip voltage VL is zero and the upper trip voltage is non-zero.

The converter current sensing voltage VS is connected to an inverting input of a comparator CMP. The non-inverting input of the comparator CMP is connected via a multiplexer MUX to either the lower trip voltage VL or the upper trip voltage VH. Feedback from the output of the comparator CMP to the multiplexer MUX selects either the lower trip voltage VL or the upper trip voltage VH. In response to a crossover of the lower trip voltage VL by the converter current sensing voltage VS in a negative direction, the comparator CMP and hysteretic comparator HCOMP thus output a switching control voltage VSW at a first logic LHL. In response to a crossover of the upper trip voltage VH by the converter current sensing voltage VS in a positive direction, the comparator CMP and the hysteretic comparator HCOMP output the switching control voltage VSW at a second logic level LLL. In case of a boundary conduction mode Buck converter, the response to the crossover of the lower trip voltage VL by the converter current sensing voltage VS in the negative direction does not immediately cause the comparator CMP and hysteretic comparator HCOMP to output a switching control voltage VSW at the first logic LHL, but this action is delayed typically until the converter current has resonated and the converter current sensing voltage again crosses the lower trip voltage but now in the positive direction, as shown in FIG. 1*d*.

The switch-mode converter SMCONV is operable to control a flow of the LED current ILED through the LED circuit arrangement LEDCIRC by controlling a flow of the converter current IL through the circuit arrangement CIRC. The switch-mode converter SMCONV is in electrical communication with the hysteretic comparator HCOMP to receive the switching control voltage VSW.

In response to the switching control voltage VSW equaling the first logic level LHL, the switch-mode converter SMCONV controls an increase of the converter current IL from the valley current level to the peak current level. This controlling of the increase of the converter current IL will continue during an increase phase TH with a time duration which will be further referred to as an increase time duration TH. In response to the switching control voltage VSW equaling the second logic level, the switch-mode converter SMCONV controls a decrease of the converter current IL from the peak current level to the valley current level. This controlling of the decrease of the converter current IL will continue during a decrease phase pL with a time duration which will be further referred to as a decrease time duration TL.

When, as in the boundary-conduction mode converter, there is also a resonant phase, this phase will be referred to as the resonant phase pH, with a resonant time duration TR.

The circuit arrangement CIRC will thus supply the LED circuit arrangement LEDCIRC with a LED current at the mean current level. The LED current oscillates with a converter current period T between a valley current level and a peak current level. The converter current period T comprises the increase time duration TH, the decrease time duration TL and, when applicable, the resonant time duration TR. The valley current level and the peak current level are dependent on the upper trip voltage VH and the lower trip voltage VL respectively. The difference between the peak current level and the valley current level will be further referred to as a peak-to-peak current ripple dI. The mean current level is dependent on the mean voltage level of the upper trip voltage VH and the lower trip voltage VL, referred to as a reference voltage level VREF. The difference between the upper trip voltage VH and the lower trip voltage VL will be referred to as the hysteresis voltage VHYS. The increase time duration TH, the decrease time duration TL and hence also the converter current period T, depend on these voltages and may be further dependent on, e.g. the circuit load of the LED circuit.

The switch-mode converter comprises a switch SW1, a diode D2 and an inductor L1. The inductor L1 is connected between an intermediate node LX, located in between the switch SW1 and the diode D2, and the LED circuit arrangement LEDCIRC. The switch SW1 and the diode D2 switch the LX node to an input voltage Vin, supplied by an external DC power supply, or to ground GND, depending on the state of the switch SW1. Switching the LX node to the input voltage Vin or to ground GND respectively charges and discharges the inductor L1 and consequently increases or decreases the current level of the converter current IL.

The bottom graph of FIG. 1*d* shows the voltage over the switch SW1 for a quasi-resonant converter. The voltage is approximately zero (the voltage drop of the switch itself is ignored for simplicity) during the increase phase pH, while the switch SW1 is closed (conducting) and the inductor L1 is being charged. When the switch is opened (and non-conducting), the voltage equals the input voltage Vin, and the converter current IL decreases while the inductor L1 is discharging. Once the converter current has decreased to zero and the switch SW1 remains open, the series arrangement of the inductor L1 and all parasitic capacitors on node LX, will resonate and the voltage will roll-off to zero, while the converter current resonates to a low negative value IPT and back to zero at time instance Tx. Although the switch may be closed before or after Tx, the optimum moment to close the switch is at Tx, as the voltage drop over the switch is then zero or minimal, and switching is done substantially without, or with minimal, losses. In prior art arrangements, the negative component of the converter current is however not accounted for when the mean current level is determined from the peak current level ILH and the valley current level ILL, like any over- or undershoots.

This class of circuit arrangements CIRC will be referred to as examples of switch-mode converters. The specific switch-mode converter described here will be referred to as an example of a converter according to a so-called Buck-converter topology. Alternative converter topologies may also be feasible within the scope of the invention. As an example, also an alternative hysteretic converter, such as a so-called hysteretic Buck-Boost-converter, or a so-called hysteretic Boost-converter may be used in embodiments of the invention.

Figure 2:
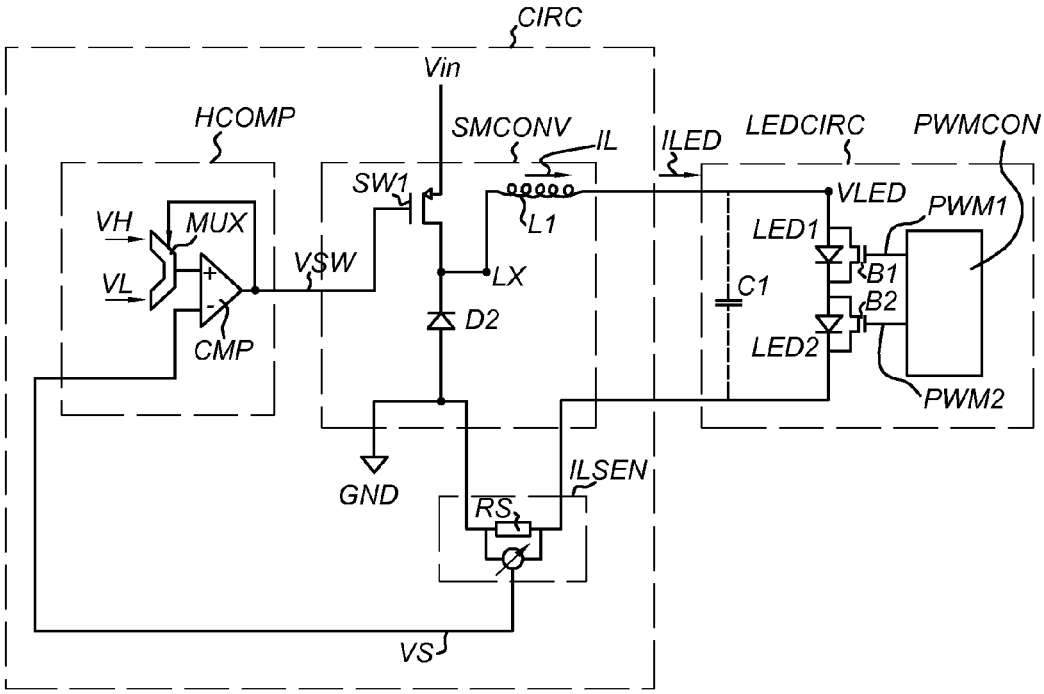
Fig 2 Prior Art
FIG. 2 schematically shows the circuit arrangement according to the prior art, supplying a current to a switchable LED arrangement.

FIG. 2 schematically shows the circuit arrangement CIRC according to the prior art, supplying a current to a switchable LED circuit arrangement LEDCIRC.

The circuit arrangement CIRC may be the same as described in reference with FIG. 1. The LED circuit arrangement LEDCIRC however comprises a first LED LED1 and a second LED LED2, each associated with a respective switching element B1, B2. The LED arrangement may further comprise an optional capacitive filter C1 to smoothen the current through the LEDs LED1, LED2. The first switching element B1 is electrically parallel to the first LED LED1 and the second switching element B2 is electrically parallel to the second LED LED2. The first and second switching elements B1, B2 are each operable by a LED segment controller PWMCON for selecting the path of the LED current to pass through the LED associated with the respective switching element or to bypass the LED associated with the respective switching element. The LED arrangement thus allows to vary the effective light output of each of the two LEDs individually, by varying the time that the LED current passes through a LED with a duty cycle of a control period. The control period is generally a period of a fixed length, also referred to as a pulse width modulation period corresponding to a pulse width modulation frequency. The duty cycle associated with operating the first LED LED1 to emit light is further referred to as the first LED duty cycle PWM1. The duty cycle associated with operating the second LED LED2 to emit light is further referred to as the second LED duty cycle PWM2.

It should be noted that in stead of a single LED, also, e.g. a plurality of LEDs arranged in series may be used and operated by a single switching element in parallel to the series arrangement of the plurality of LEDs. This may also be referred to as a LED segment. The LEDs from the plurality of LEDs in a single LED segment may have substantially the same colour, but the colours may also be different between the LEDs within a segment. When referring to "LED" in the following, it shall be understood to also refer to embodiments using a "LED segment" comprising a plurality of LEDs.

When the two LEDs LED1, LED2 are operated with duty cycles PWM1, PWM2 using the switches B1, B2, the circuit load of the LED circuit arrangement will differ as a consequence of the different voltage drop VLED over the LED circuit arrangement depending on which switch is open and which is closed. The hysteretic converter will however maintain the mean current level as the same value, due to the operating mechanism described above in reference with FIG. 1. However, in doing so, the LED current frequency—or the LED current period or the, for this converter type equivalent, converter current period—of the oscillation of the LED current will differ. A preferred embodiment will be discussed below which takes this variation of the oscillation period onto account.

As the circuit load of the LED circuit arrangement changes, e.g. when switching from one setting of the switches B1, B2 to another, the mean current level may take some time to settle when a classical feed-back loop is used. The current invention aims to provide a fast and accurate correction once the current deviates from the required mean current level.

Figure 3:
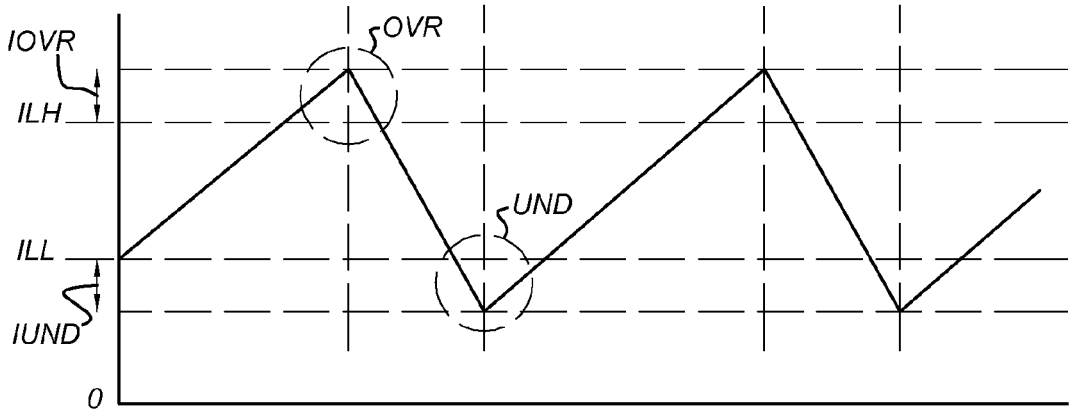
FIG. 3 schematically shows electrical signals related to the circuit arrangement of FIG. 1*a* with over- and undershoots.

FIG. 3 schematically shows electrical signals related to the circuit arrangement of FIG. 1*a* with over- and undershoots for a hysteretic Buck converter. The situation may occur for high conversion frequencies. An overshoot OVR corresponds to the converter current continuing to increase during a short time duration after the peak current level ILH, associated with the upper trip voltage VH, has been reached, e.g. due to delays in the circuit, with the converter current increasing up to a current overshoot IOVR above the peak current level ILH. Likewise, an undershoot UND corresponds to the converter current continuing to decrease during a short time duration after the valley current level ILL associated with the lower trip voltage VL, has been reached, with the converter current decreasing down to a current undershoot IUND below the valley current level ILL. The contributions from the overshoot OVR and undershoot UND will generally not cancel each other. Hence, the average of the current actually delivered by the converter is no longer (ILH+ILL)/2, but rather (ILH+IOVR+ILL−IUND)/2, i.e. deviate by (IOVR−IUND)/2 from (ILH+ILL)/2.

Figure 4:
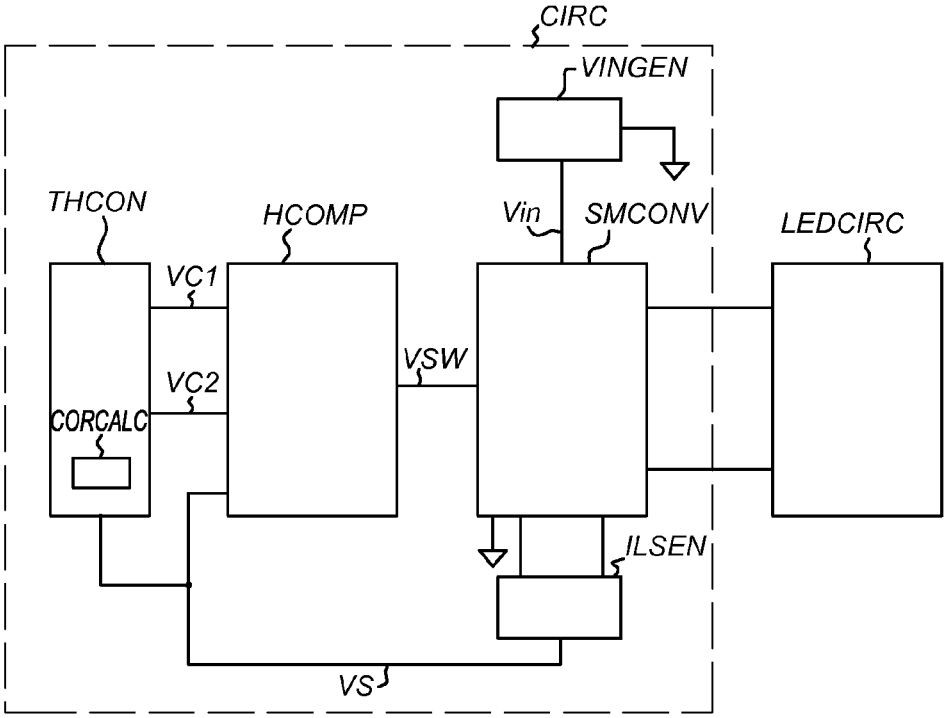
FIG. 4 schematically shows a block diagram of embodiments of circuit arrangements according to the invention.

FIG. 4 schematically shows a block diagram of an embodiment of a circuit arrangement CIRC according to the invention, in electrical communication with a led circuit arrangement LEDCIRC. Details of the different elements of the circuit arrangement CIRC and the LED circuit arrangement LEDCIRC are not drawn, but will be described for different embodiments further below.

In FIG. 4, the circuit arrangement comprises a converter current sensor ILSEN, a hysteretic comparator HCOMP, a switch-mode converter SMCONV, a correction calculator CORCALC, a threshold controller THCON and a power supply VINGEN.

The converter current sensor ILSEN may be of the type described in reference with FIG. 1, and is in electrical communication with at least the hysteretic comparator HCOMP, the switch-mode converter SMCONV and the threshold controller THCON.

The switch-mode converter SMCONV may be of the type described in reference with FIG. 1, and is in electrical communication with at least the converter current sensor ILSEN to receive the converter current IL, the hysteretic comparator HCOMP to receive a switching control voltage VSW and, the power supply VINGEN to receive the input voltage Vin.

The hysteretic comparator HCOMP is in electrical communication with the switch-mode converter SMCONV and threshold controller THCON. The hysteretic comparator HCOMP is arranged to receive a first trip control voltage VC1 and a second trip control voltage VC2 from the threshold controller THCON. The hysteretic comparator HCOMP is operable to establish the upper trip voltage VH and the lower trip voltage VL from the first trip control voltage VC1 and the second trip control voltage VC2. The hysteretic comparator HCOMP may further operate like the hysteretic comparator HCOMP described in reference with FIG. 1, and is thus operable to output a switching control voltage VSW to the switch-mode converter SMCONV.

The threshold controller THCON is a new and inventive element to the circuit arrangement according to the invention.

The threshold controller THCON is operable to adjust at least one of the upper trip voltage VH and the lower trip voltage VL, via offering an adjusted first trip control voltage VC1 and second trip control voltage VC2 for use with the next, successive cycle of the conversion current, based on the current level correction determined by the correction calculator CORCALC. In this exemplary embodiment, the correction calculator CORCALC is part of the threshold controller THCON, but it may also be a separate unit in electrical communication with the threshold controller THCON.

The correction calculator CORCALC is operable for determining the current level correction for compensating the current level error between the integral over the oscillation cycle of the LED current and the reference. The correction calculator CORCALC is in electrical communication with the converter current sensor ILSEN to receive the converter current sensing voltage VS. Exemplary embodiments of the correction calculator CORCALC will be discussed below.

Figure 5:
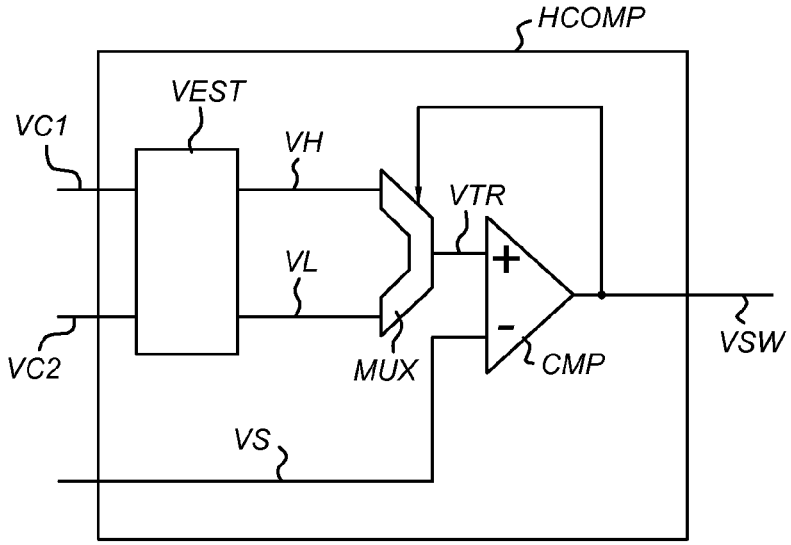
FIG. 5 shows an exemplary embodiment of a hysteretic comparator usable in embodiments of a circuit arrangement according to the invention.

FIG. 5 shows an exemplary embodiments of the hysteretic comparator HCOMP being a part of an embodiment of a circuit arrangement CIRC according to the invention. The hysteretic comparator HCOMP is operable to receive the first and second trip control voltages VC1, VC2 from the converter current period detector FDET in a voltage establishing unit VEST. The voltage establishing unit VEST is operable to establish values of the upper and lower trip voltages VH, VL in response to the first and second trip control voltages VC1, VC2.

The first and second trip control voltages VC1, VC2 may be the upper trip voltage and lower trip voltage required to be applied for controlling the converter current period to be within the period control range Tref. The hysteretic comparator HCOMP may then use the first and second trip control voltages VC1, VC2 as the new upper and lower trip voltages VH, VL.

Alternatively, the first and second trip control voltages VC1, VC2 may be adjustment values to the upper and lower trip voltages VH, VL as being applied. The hysteretic comparator HCOMP may then add the first and second trip control voltages VC1, VC2 to the upper and lower trip voltages VH, VL to obtain new upper and lower trip voltages VH, VL.

The non-inverting input of a comparator CMP is connected via a multiplexer MUX to either the lower trip voltage VL or the upper trip voltage VH. The converter current sensing voltage VS is connected to an inverting input of the comparator CMP. Feedback from the output of the comparator CMP to the multiplexer MUX selects either the lower trip voltage VL or the upper trip voltage VH as a trip voltage VTR on the output of the multiplexer MUX. In response to a crossover of the lower trip voltage VL by the converter current sensing voltage VS in a negative direction, the comparator CMP and hysteretic comparator HCOMP output a switching control voltage VSW at a first logic LHL. In response to a crossover of the upper trip voltage VH by the converter current sensing voltage VS in a positive direction, the comparator CMP and the hysteretic comparator HCOMP output the switching control voltage VSW at a second logic level LLL.

When a quasi-resonant topology is used, the hysteretic comparator HCOMP may be arranged to delay outputting the switching control voltage VSW at the first logic LHL upon the crossover of the lower trip voltage VL by the converter current sensing voltage VS in a negative direction. The hysteretic comparator HCOMP may e.g. be arranged to output the switching control voltage VSW at the first logic LHL upon a later crossover of the lower trip voltage VL by the converter current sensing voltage VS in a positive direction.

Figure 6A:
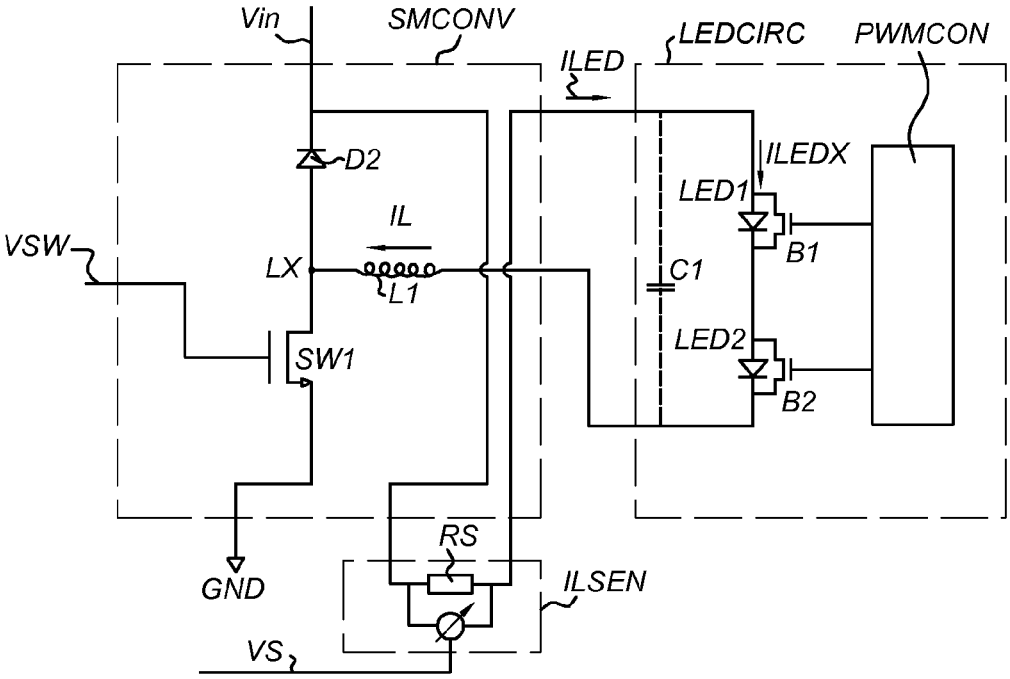
FIG. 6*a* shows an exemplary embodiment of a switch-mode converter of the Buck-converter type and the associated converter current sensor usable in embodiments of a circuit arrangement according to the invention, electrically connected to an exemplary embodiment of a LED circuit arrangement.
Figure 6B:
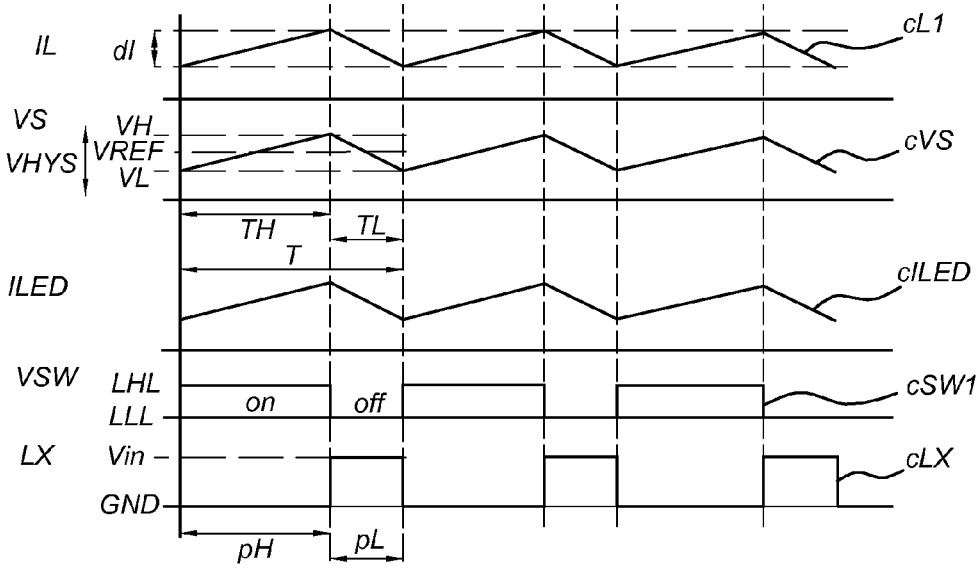
FIG. 6*b* shows electrical signals related to the embodiment of FIG. 6*a* without the optional capacitor in the LED circuit arrangement.
Figure 6C:
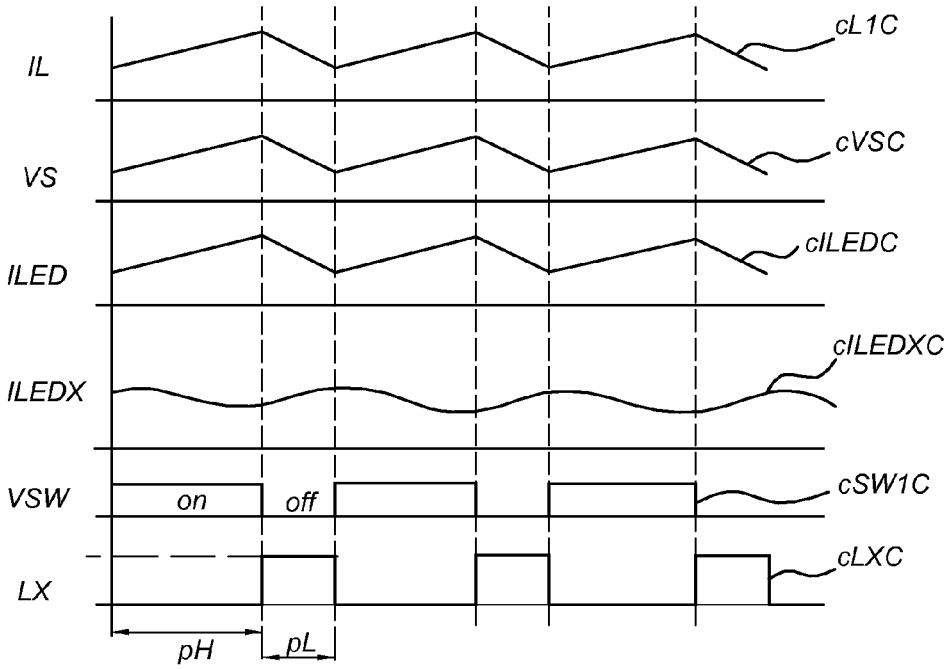
FIG. 6*c* shows electrical signals related to the embodiment related to the embodiment of FIG. 6*a* with the optional capacitor.

FIG. 6*a* shows an exemplary embodiments of switch-mode converters of the Buck-converter type and the associated converter current sensor as used in embodiments of a circuit arrangement according to the invention and associated electrical signals. FIG. 6*b* shows electrical signals related to the embodiment of FIG. 6*a* without the optional capacitor C1 in the LED circuit arrangement; FIG. 6*c* shows electrical signals related to the embodiment related to the embodiment of FIG. 6*a* with the optional capacitor C1.

The switch-mode converter SMCONV shown in FIG. 6*a* includes a switch SW1, a diode D2 and an inductor L1. The switch-mode converter SMCONV is a variant of the one described in reference to FIG. 1. The inductor L1 is connected between an intermediate node LX, located in between the switch SW1 and the diode D2, and the LED circuit arrangement LEDCIRC. The switch SW1 and the diode D2 switch the LX node to an input voltage Vin, supplied by an external DC power supply, or to ground GND, depending on the state of the switch SW1. Switching the LX node to the input voltage Vin or to ground GND respectively charges and discharges the inductor L1 and consequently increases or decreases the current level of the converter current IL.

FIG. 6*b* shows electrical signals related to the embodiment of FIG. 6*a*. Curve cL1 shows the converter current IL as a function of time, i.e. the current through the inductor L1 and through the sense resistor RS. Curve cVS shows the current sensing voltage VS as a function of time. Curve cILED shows the LED current ILED as a function of time, i.e. the current flowing through the LEDs (when the associated bypass switch in the LED circuit arrangement is open). Curve cSW1 shows the switching control voltage VSW, which can take a high logic level LHL corresponding to a closed switch SW1 or a low logic level LLL corresponding to an open switch SW1. Curve cLX shows the voltage at node LX, which can take a low value corresponding to ground or a high value corresponding to the input voltage Vin.

The switch-mode converter SMCONV is operable to control a flow of the LED current ILED with a mean current level through the LED circuit arrangement LEDCIRC. The switch-mode converter SMCONV is in electrical communication with the hysteretic comparator HCOMP to receive the switching control voltage VSW.

In response to the switching control voltage VSW equaling the first logic level LHL, the switch-mode converter SMCONV may control an increase of the converter current IL from the valley current level to the peak current level, as is shown in FIG. 6*b*. This controlling of the increase of the converter current will continue for a time duration which will be further referred to as an increase time duration TH. This phase of controlling may be further referred to as an increase phase pH. In response to the switching control voltage VSW equaling the second logic level, the switch-mode converter SMCONV may control a decrease of the converter current IL from the peak current level to the valley current level. This controlling of the decrease of the converter current will continue for a time duration which will be further referred to as a decrease time duration TL. This phase of controlling may be further referred to as a decrease phase P1.

The circuit arrangement CIRC will thus supply the LED circuit arrangement LEDCIRC with a LED current at the mean current level, which oscillates with a converter current period T between a valley current level and a peak current level. The valley current level and the peak current level are dependent on the upper trip voltage VH and the lower trip voltage VL respectively. The difference between the peak current level and the valley current level will be further referred to as a peak-to-peak current ripple dI. The mean current level is dependent on the mean voltage level of the upper trip voltage VH and the lower trip voltage VL, referred to as a reference voltage level VREF. The difference between the upper trip voltage VH and the lower trip voltage VL will be referred to as a hysteresis voltage VHYS. The increase time duration TH, the decrease time duration TL and hence also the converter current period T, depend on these voltages and may be further dependent on, e.g. the circuit load of the LED circuit.

The converter current sensor ILSEN shown in FIG. 6*a* comprises a sense resistor RS in the current path of the converter current IL and is operable to perform a voltage measurement over the sense resistor RS. The measured voltage may be outputted as the converter current sensing voltage VS.

FIG. 6*c* shows electrical signals related to the embodiment of FIG. 6*a* with the optional capacitor C1. Curve cL1C shows the converter current IL as a function of time, i.e. the current through the inductor L1 and through the sense resistor RS. Curve cVSC shows the current sensing voltage VS as a function of time. Curve cILEDC shows the LED current as a function of time, i.e. the current fed to the LED circuit arrangement. Curve cILEDXC shows the current flowing through the LEDs themselves (when the associated bypass switch in the LED circuit arrangement is open). Curve cSW1C shows the switching control voltage VSW, which can take a high logic level LHL corresponding to a closed switch SW1 or a low logic level LLL corresponding to an open switch SW1. Curve cLXC shows the voltage at node LX, which can take a low value corresponding to ground or a high value corresponding to the input voltage Vin.

Comparing the curves cILEDC and cILEDXC, it can be observed that the capacitive filter C1 provides a smoothing of the current amplitude as actually flowing through the LEDs, with the beneficial effects that the lifetime of the LEDs is increased since the peak current level through the LEDs is reduced. Also the ripple amplitude of the current through the LEDs is reduced, reducing the ripple amplitude of the light level. Alternatively, with a capacitive filter C1, a larger fluctuation of the converter current can be allowed through the inductor to achieve the same current ripple amplitude through the LEDs as for a LED circuit arrangement without a capacitive output filter, which has the advantage of a smaller inductance value and size.

Figure 6D:
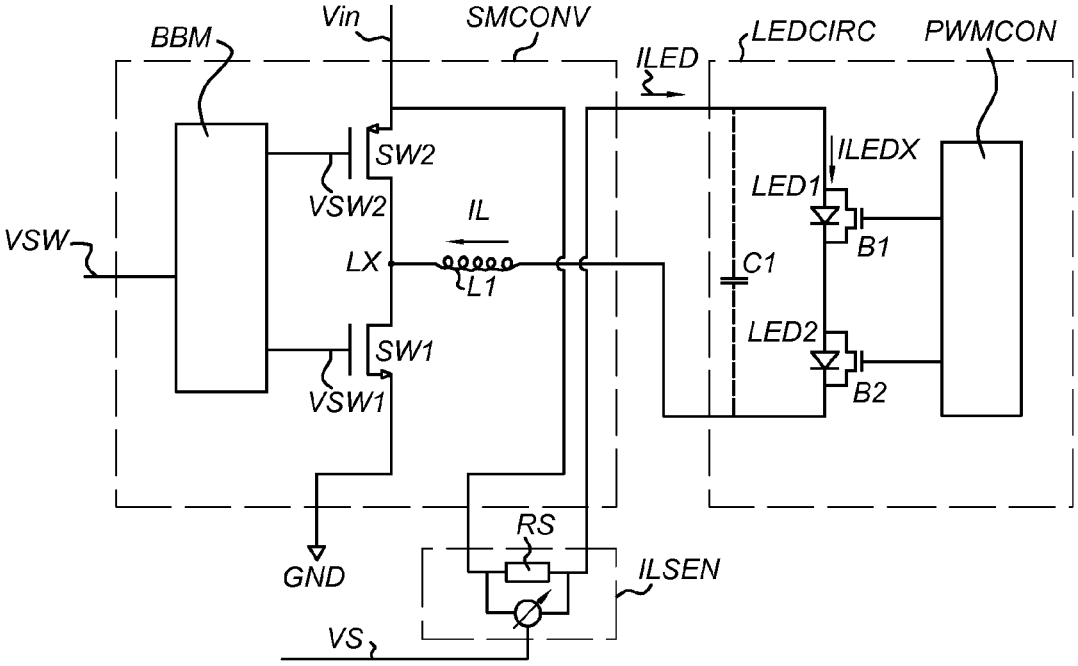
FIG. 6*d* shows an alternative exemplary embodiment of a switch-mode converter of the Buck-converter type.

The switch-mode converter SMCONV shown in FIG. 6*d* includes a switch SW1, a second switch SW2 and an inductor L1. The inductor L1 is connected between an intermediate node LX, located in between the switch SW1 and the second switch SW2, and the LED circuit arrangement LEDCIRC. The switch SW1 and the second switch SW2 switch the LX node to an input voltage Vin, supplied by an external DC power supply, or to ground GND, depending on the state of the switch SW1 and SW2. Switching the LX node to the input voltage Vin or to ground GND respectively charges and discharges the inductor L1 and consequently increases or decreases the current level of the converter current IL.

The switch-mode converter SMCONV is in electrical communication with the hysteretic comparator HCOMP to receive the switching control voltage VSW via a break-before-make circuit BBM. The break-before-make circuit BBM comprises a timing circuit which assures that the two switches SW1 and SW2 can not both be closed at the same time, as this would result in a short circuit of the input voltage Vin and the ground voltage. The break-before-make circuit BBM is thus operable to generate a first and a second switching control voltage VSW1, VSW2 from the switching control voltage VSW which operate the switches SW1 and SW2 to never be closed simultaneously.

The converter current sensor ILSEL in FIG. 6*d* is similar to the one shown in FIG. 6*a*.

Electrical signals related to the embodiment of FIG. 6*d* are substantially the same as the electrical signals shown in FIG. 6*b* and FIG. 6*c* in relation with the embodiment of FIG. 6*a*, and are not drawn again.

The method of integration will be explained in reference with FIG. 7, before describing an embodiment of an correction calculator CORCALC and a threshold controller THCON implementing the method.

Figure 7:
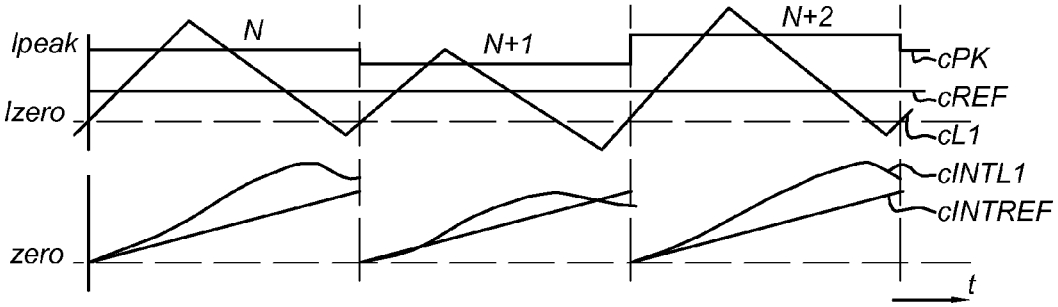
FIG. 7 shows examples of integration usable in embodiments of a circuit arrangement according to the invention.

FIG. 7 shows three examples of integration over an oscillation period according to the invention for three oscillation periods, labelled with N, N+1 and N+2. FIG. 7. shows three examples of current levels and integration results for a normal Buck converter. The curves cREF show curves of a reference current with a reference current level representative of the mean LED current level. The curves cL1 show curves of an integration current, the integration current being representative of the LED current. The levels Ipeak and Izero show indications of the crossover signal levels during the different oscillation periods, i.e. the peak current level and the valley current level respectively.

The curves cINTREF show a progression of the integration of the reference current over each respective oscillation period, resulting in a reference current integral at the end of the periods. The curves cINTL1 show a progression of the integration of the integration current over the corresponding oscillation periods, each resulting in an actual current integral at the end of each respective period. The start points for the integration are determined from a crossover of the Izero level by the integration current. The end points are determined from the next crossover in the same direction of the Izero level by the integration current. The integrations of the reference current and of the integration current use the same start and stop points.

In oscillation period N, the conversion current shows quite some overshoot above the peak current level and also some undershoot below the valley current level. At the end of the oscillation period, the actual current integral is larger than the reference current integral. As a result, the peak current level is reduced for the next oscillation period N+1.

In oscillation period N+1, the conversion current shows some overshoot above the peak current level and quite some undershoot below the valley current level. At the end of the oscillation period, the actual current integral is smaller than the reference current integral. As a result, the peak current level is increased for the next oscillation period N+2.

When the method is well-tuned and the integrations are done sufficiently accurate, the method generally converges within one or two conversion cycles, in contract to classical feed-back systems requiring typically ten cycles or more.

Figure 8:
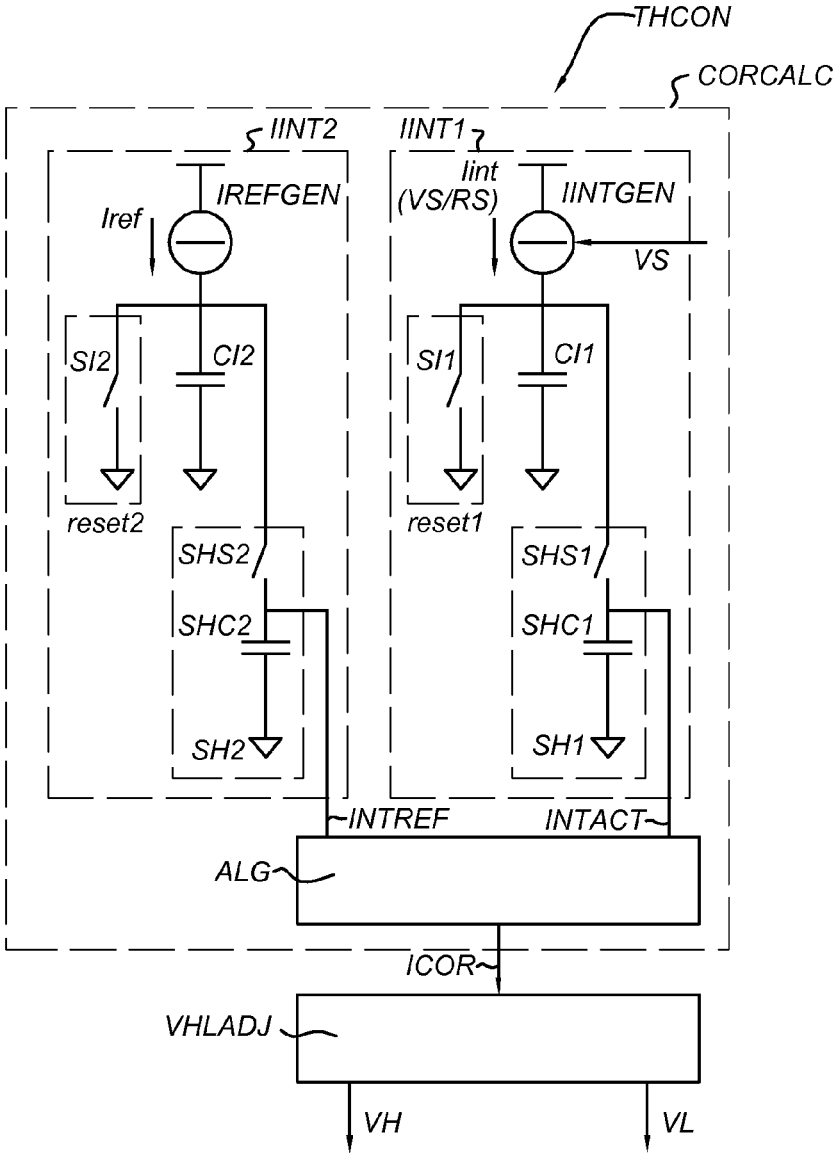
FIG. 8 shows an exemplary embodiment of a correction calculator usable in embodiments of a circuit arrangement according to the invention.

FIG. 8 shows an exemplary embodiment of a correction calculator CORCALC according to the invention in electrical communication with a trip voltage adjustment calculator VHLADJ. The trip voltage adjustment calculator VHLADJ is part of the threshold controller THCON. In this example, the correction calculator CORCALC is also part of the threshold controller THCON, but it may also be a separate functional unit in communication with the threshold controller THCON.

The correction calculator CORCALC comprises two integrators: a first current integrator IINT1 operable for obtaining an actual current integral INTACT and a second current integrator IINT2 operable for obtaining a reference current integral INTREF. During use, the actual current integral INTACT and the reference current integral INTREF are received by an algorithmic unit ALG for determining the current level correction ICOR. The current level correction ICOR is then passed to the trip voltage adjustment calculator VHLADJ for determining an adjusted value of at least one of the upper trip voltage VH and the lower trip voltage VL. In this example, we will use a lower trip voltage of zero, as in a normal Buck converter or in a boundary-conduction mode converter.

The first current integrator IINT1 comprises an integration current establisher IINTGEN which, during use, establishes an integration current lint. The integration current lint is established using a bi-directional current source which receives the converter current sensing voltage VS and generates the integration current in proportion with the converter current sensing voltage VS, hence with the converter current IL. The integration current lint thus follows the variations of the converter current IL. The integration current is then accumulated on a capacitor CI1, which is reset using a switch SI1 discharging the capacitor to ground before starting the accumulation of the integration current from the start point to the stop point, i.e. over one oscillation cycle. The accumulated result may be stored on a sample-and-hold capacitor SHC1 using a sample-and-hold switch SHS1. The accumulated result is then provided as the actual current integral INTACT to the algorithmic unit ALG.

The second current integrator IINT2 operates in a similar fashion. A reference current establisher IREFGEN establishes, during use, a reference current Iref with a reference current level representative of the mean LED current level. The reference current level may be a constant level provided to the reference current establisher IREFGEN from a current set-point derived from a required light output level of the LED circuit arrangement LEDCIRC connected to the circuit arrangement CIRC during use. The reference current level may alternatively be determined real-time, including also other parameters, e.g. from a colour processing unit detecting the light output level for each of a plurality of LEDs generating light with different colours to achieve mixed light of a certain colour and determining individual light output levels, and current levels, for each of the plurality of LED to achieve the certain colour of mixed light. The reference current level is preferably constant over a single oscillation cycle. The reference current is then accumulated on a second capacitor CI2, which is reset using a second switch SI2 discharging the second capacitor CI2 to ground before starting the accumulation of the reference current from the start point to the stop point, i.e. over one oscillation cycle. The accumulated result may be stored on a second sample-and-hold capacitor SHC2 using a second sample-and-hold switch SHS2. The accumulated result is then provides as the reference current integral INTREF to the algorithmic unit ALG.

The algorithmic unit ALG then determines the current level correction ICOR from at least the actual current integral INTACT and the reference current integral INTREF.

In an embodiment, the current level correction ICOR is determined by the algorithmic unit ALG from dividing the reference current integral INTREF by the actual current integral INTACT. The trip voltage adjustment calculator VHLADJ in the threshold controller THCON then adjusts the peak current level, implemented via adjusting the upper trip voltage VH, by multiplying the peak current level from the integrated oscillation cycle N with the level correction ICOR for use with the next oscillation cycle N+1. This can be expressed as adjusting the upper trip voltage VH as:

$$VH(N+1)=VH(N)*\text{INTREF/INTACT}.$$

When applied with a hysteretic Buck-converter, the lower trip voltage is similarly adapted as:

$$VL(N+1)=VL(N)*\text{INTREF/INTACT}.$$

In another embodiment, the current level correction ICOR is determined by the algorithmic unit ALG from subtracting the actual current integral INTACT from the reference current integral INTREF, and dividing the result by the time duration T of the oscillation cycle. When adjusting just the upper trip voltage VH as in a normal Buck converter or a quasi-resonant Buck-converter, the current level correction ICOR may incorporate a further multiplication with a factor of two to take into account the relation between the average current level and the peak current level for the triangular or saw-tooth shape between substantially zero and the peak current level. The trip voltage adjustment calculator VHLADJ in the threshold controller THCON then adjusts the peak current level, implemented via adjusting the upper trip voltage VH, by adding the current level correction ICOR to the peak current level from the integrated oscillation cycle N for use with the next oscillation cycle N+1. This can be expressed as $$VH(N+1)=VH(N)+2*(\text{INTREF}-\text{INTACT})/T(N);$$

$$VL(N+1)=VL(N).$$

When applied with a hysteretic Buck-converter, the upper and lower trip voltage maybe be both adapted according to:

$$VH(N+1)=VH(N)+(\text{INTREF}-\text{INTACT})/T(N);$$

$$VL(N+1)=VL(N)+(\text{INTREF}-\text{INTACT})/T(N);$$

or in another way by which the average of VH(N+1) and VL(N+1) increases with (INTREF−INTACT)/T(N) compared to VH(N) and VL(N).

Figure 9:
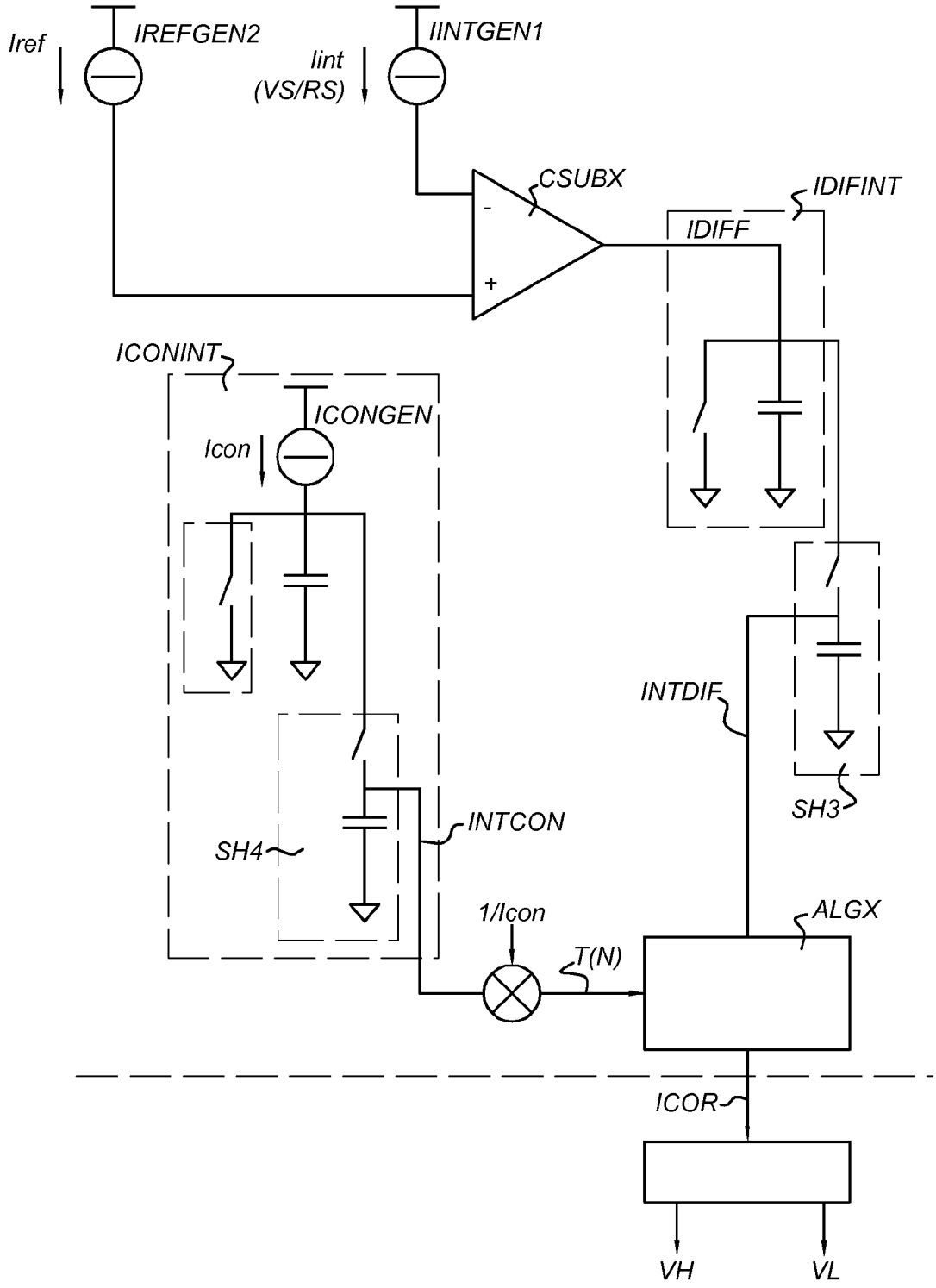
FIG. 9 show another exemplary embodiment of a correction calculator usable in embodiments of a circuit arrangement according to the invention.

FIG. 9 shows another exemplary embodiment of a correction calculator CORCALC according to the invention in electrical communication with a trip voltage adjustment calculator VHLADJ. The trip voltage adjustment calculator VHLADJ is part of the threshold controller THCON. Again, in this example, the correction calculator CORCALC is also part of the threshold controller THCON, but it may also be a separate functional unit in communication with the threshold controller THCON.

The correction calculator CORCALC comprises again an integration current establisher IINTGEN which, during use, establishes an integration current lint in dependence on VS, in a similar manner as described with reference to FIG. 8, representative of the LED current ILED, and a reference current establisher IREFGEN which establishes, during use, a reference current Iref with a reference current level representative of the mean LED current level.

The reference current Iref is subtracted from the integration current lint using a subtractor CSUBX to obtain a current difference IDIFF. The current difference is integrated in a current difference integrator IDIFINT again by charging a capacitor which is reset at the start of the oscillation cycle. The integration result INTDIF is delivered to an algorithmic unit ALGX for determining the current level correction ICOR by dividing the integration result INTDIF by the time duration T of the oscillation cycle. When adjusting just the upper trip voltage VH as in a normal Buck converter or a quasi-resonant Buck-converter, the current level correction ICOR may incorporate a further multiplication with a factor of two to take into account the relation between the average current level and the peak current level for the triangular or saw-tooth shape between substantially zero and the peak current level. The trip voltage adjustment calculator VHLADJ in the threshold controller THCON then adjusts the peak current level, implemented via adjusting the upper trip voltage VH, by adding the current level correction ICOR to the peak current level from the integrated oscillation cycle N for use with the next oscillation cycle N+1. This can be expressed as $$VH(N+1)=VH(N)+2*\text{INTDIF}/T(N);$$

$$VL(N+1)=VL(N).$$

When applied with a hysteretic Buck-converter, the upper and lower trip voltage maybe be both adapted according to:

$$VH(N+1)=VH(N)+\text{INTDIF}/T(N);$$

$$VL(N+1)=VL(N)+\text{INTDIF}/T(N);$$

or in another way by which the average of VH(N+1) and VL(N+1) increases with INTDIF/T(N) compared to VH(N) and VL(N).

FIG. 9 also shows an example of obtaining the time duration T of the oscillation cycle. A constant current establisher ICONGEN establishes, during use, a constant current Icon with a constant current level. The constant current Icon is integrated with a constant current integrator ICONINT by accumulating the constant current on a capacitor, which is reset using a switch discharging the capacitor to ground before starting the accumulation of the constant current from the start point to the stop point, i.e. over one oscillation cycle. The accumulated result may be stored on a sample-and-hold capacitor SHC4 using a sample-and-hold switch SHS4. The accumulated result is then provided as the constant current integral INTCON, which is normalized with the constant current level 1/Icon to obtain the time duration T(N) of oscillation cycle N and then delivered to the algorithmic unit ALG.

As a Buck-converter type switch-mode converter is not suitable for use with a LED circuit arrangement LEDCIRC which may have a voltage drop VLED over the LED circuit arrangement LEDCIRC that is larger than the input voltage Vin, a Buck-Boost converter topology may be preferred in some situations. The invention can also be applied with switch-mode converters according to a Buck-Boost converter topology.

Figure 10A:
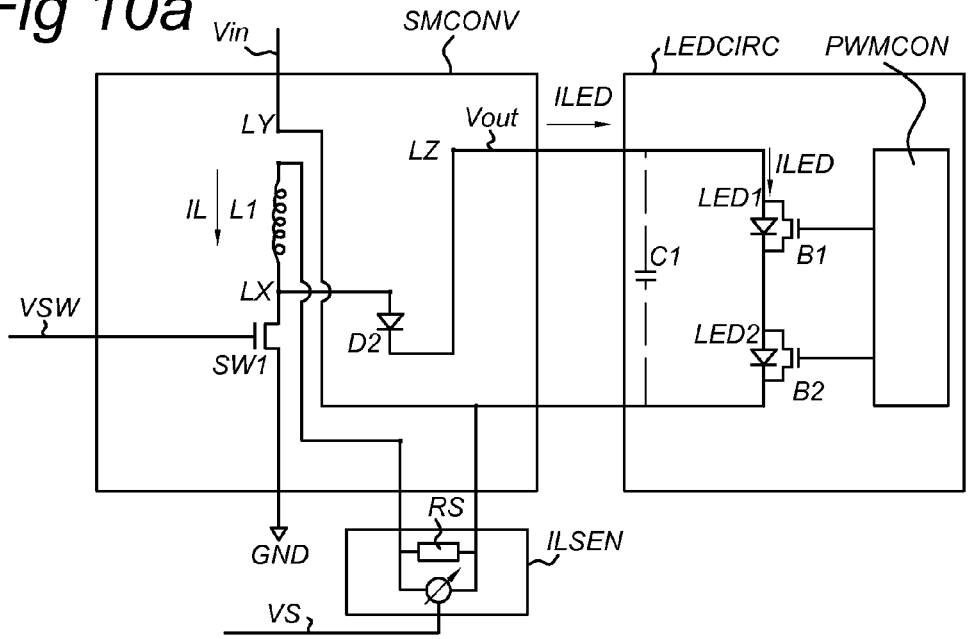
FIG. 10*a* shows an exemplary embodiment of switch-mode converters of the Buck-Boost converter type, electrically connected to an exemplary embodiment of a LED circuit arrangement.

A first example of such a Buck-Boost switch-mode converters is shown in FIG. 10*a*.

The switch-mode converter SMCONV shown in FIG. 10*a* includes a switch SW1, a diode D2 and an inductor L1. The switch-mode converter SMCONV is connected to current sense resistor RS of a converter current sensor ILSEN. The inductor L1 is connected to the input voltage Vin via the current sense resistor RS and an intermediate node LY. The inductor L1 via an intermediate node LX to the switch SW1 which can connect to ground GND. The LED circuit arrangement LEDCIRC is connected to the intermediate node LX via an intermediate node LZ and the diode D2, to the input voltage Vin via a node LY. and to the inductor L1 via node LY and the sense resistor RS of the converter current sensor ILSEN.

An exemplary LED circuit arrangement LEDCIRC is shown with two LEDs in a series arrangement. An optional capacitor C1 may be placed as an capacitive filter between the input and output of the LED circuit arrangement, i.e. in parallel to the series arrangement of the LEDs, to provide a smoothing of the LED current amplitude.

Figure 10B:
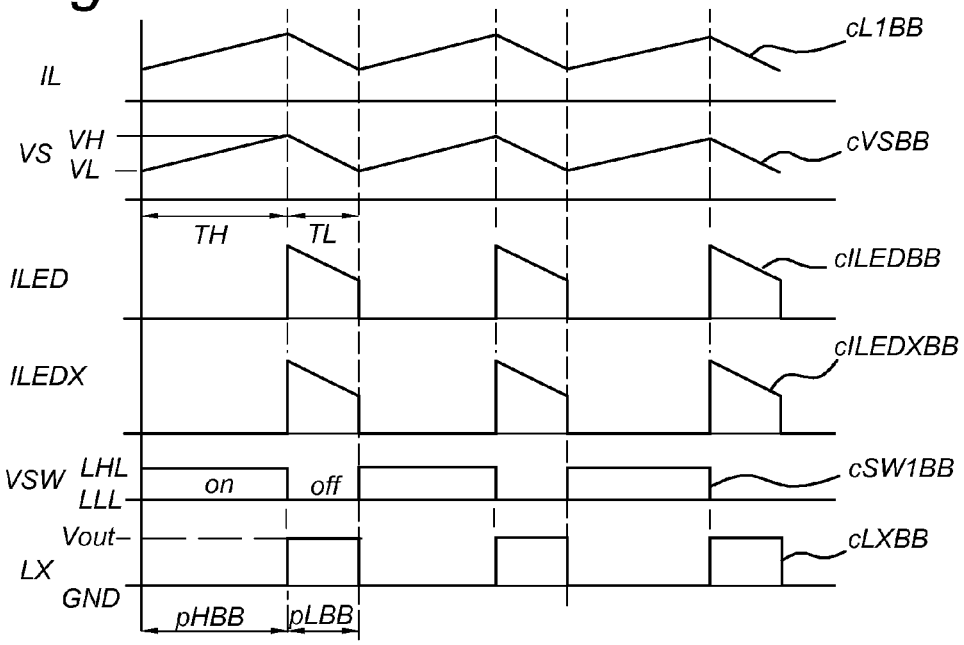
FIGS. 10*b* and 10*c* shows electrical signals related to the embodiment of FIG. 10*a* without and with an optional capacitor in the LED circuit arrangement respectively.
Figure 10C:
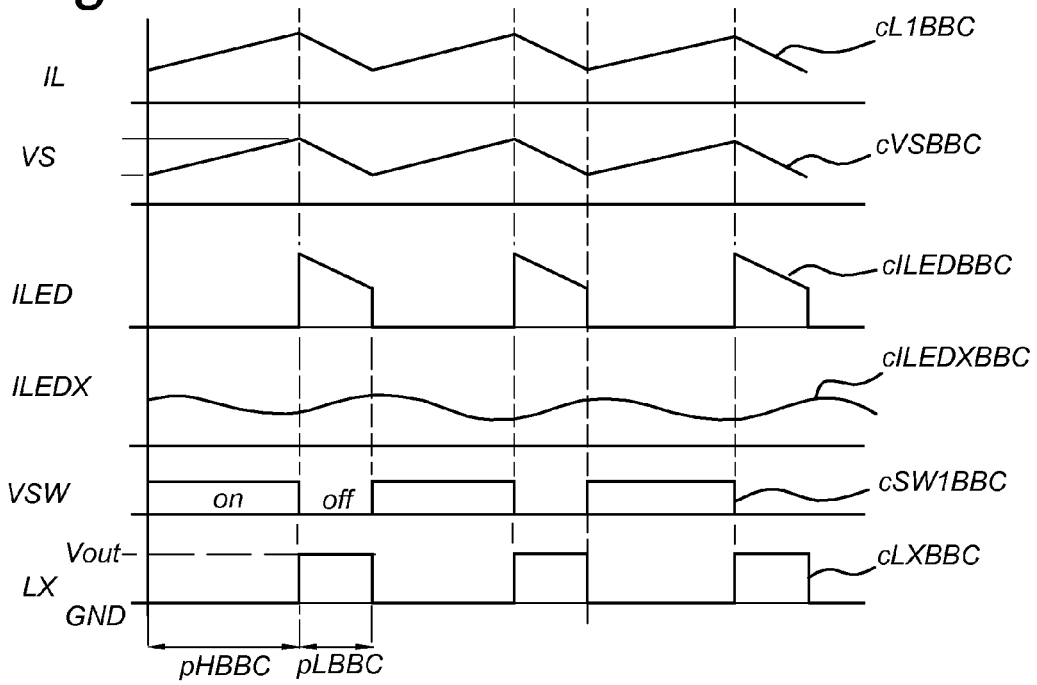

FIGS. 10*b* and 10*c* shows electrical signals related to the embodiment of FIG. 10*a* without and with an optional capacitor in the LED circuit arrangement respectively. Curves cL1BB and cL1BBC show the converter current IL as a function of time, i.e. the current through the inductor L1 and through the sense resistor RS, for the LED circuit arrangement LEDCIRC without and with the capacitor C1 respectively. Curves cVSBB and cVSBBC show the current sensing voltage VS as a function of time. Curve cILEDBB and cILEDBBC show a LED current ILED as a function of time, i.e. the current fed from the circuit arrangement CIRC to the LED circuit arrangement LEDCIRC. Curve cILEDXBB and cILEDXBBC show the current through the LED-branch as a function of time, i.e. the current flowing through the series arrangement of LEDs (when the associated bypass switch in the LED circuit arrangement is open). Curves cSW1BB and cSW1BBC show the switching control voltage VSW, which can take a high logic level LHL corresponding to a closed switch SW1 or a low logic level LLL corresponding to an open switch SW1. Curves cLXBB and cLXBBC show the voltage at node LX, which can take a low value corresponding to ground or a high value corresponding to the output voltage Vout. To maintain Volt-second balance for the inductor L1 it can be seen that the output voltage Vout is always larger than the input voltage Vin. Since the LED circuit arrangement LEDCIRC is connected between Vout and Vin, a voltage can be generated over the LED circuit arrangement LEDCIRC that is not necessarily smaller than Vin (as for a Buck-converter) but may also be larger than Vin, thus allowing to handle a wide range of load variation of the LED circuit arrangement.

Intermediate node LX switches to an output voltage Vout, or to ground GND, depending on the state of the switch SW1, as is shown by the curve cLXBB showing the voltage at node LX and the curve cSW1BB showing the switching voltage VSW in FIG. 10*b* and the curves cLXBBC and cSW1BBC in FIG. 10*c*. Switching the LX node to the output voltage Vout or to ground GND respectively discharges and charges the inductor L1 and consequently increases or decreases the current level of the converter current IL in a decrease phase pLBB, P1BBC and an increase phase pHBB, pHBBC respectively.

In this example of the Buck-Boost converter feeding a LED circuit arrangement of a series arrangement of LEDs, a flow of the converter current IL to the LED circuit arrangement, indicated in the figures as a transfer current ITR, is prevented during the increase phase pHBB, pHBBC, in which the switch SW1 is closed, connecting node LX to ground GND, as is shown by curves cILEDBB in FIG. 10*b*. The transfer current ITR is thus zero during the increase phase pHBB, pHBBC, and hence the LED current ILED is also zero when the LED circuit arrangement has no capacitor C1. During the decrease phase pLBB, pLBBC, the switch SW1 is open, the inductor L1 discharges via the diode D2 and the inductor L1 thus feeds the converter current IL as the LED current ILED to the LED circuit arrangement, such that the LED current is equal to the converter current during the decrease phase pLBB, pLBBC. The mean LED current level thus is a weighted average of the peak current level and the valley current level of the converter current.

When the optional capacitor C1 is present in the LED circuit arrangement, the LED current ILED current feeding the LED circuit arrangement still has the same shape as curve cILEDBB in FIG. 10*b*, but the current ILEDX flowing through (or bypassing) the LEDs is smoothed and behaves as shown as cILEDXBBC in FIG. 10*c*. Comparing the curves in FIG. 10*c* with the curves in FIG. 10*b*, it can be observed that the capacitive filter C1 provides a smoothing of the current amplitude, with the beneficial effects that the lifetime of the LEDs is increased since the peak current level through the LEDs is reduced. Also the ripple amplitude of the current ILEDX through the LEDs is reduced, reducing the ripple amplitude of the light level. Alternatively, with a capacitive filter C1, a larger fluctuation of the converter current can be allowed through the inductor to achieve the same current ripple amplitude as for a LED circuit arrangement without a capacitive output filter, which has the advantage of a smaller inductance value and size.

The relation between the converter current, shown as cL1BB and cL1BBC in FIG. 10*b* and FIG. 10*c* respectively, and the LED current, shown as cLEDBB and cLEDBBC in FIG. 10*b* and FIG. 10*c* respectively, is taken into account when determining the upper trip current level or upper trip voltage level and determining the lower trip current level or lower trip voltage level.

The converter current sensor ILSEL in FIG. 10*a* is similar to the one shown in FIG. 6*a*, but may also be of a similar type as the one shown in FIG. 6*c*.

Figure 11:
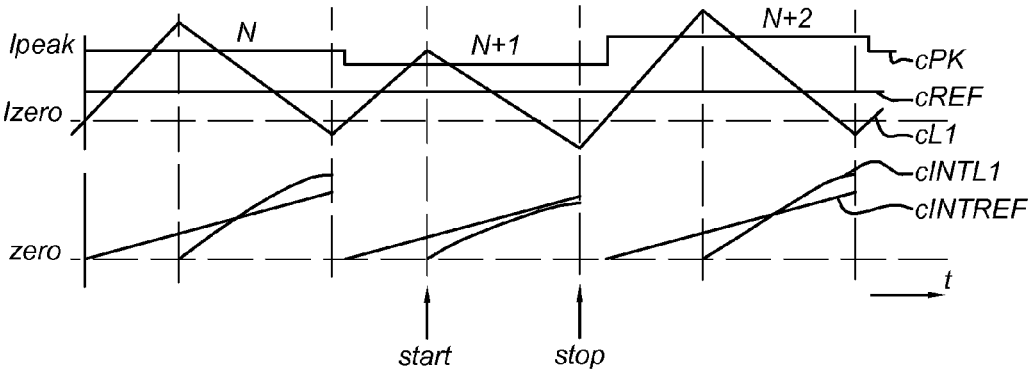
FIG. 11 shows examples of electrical signals and integration thereof usable in embodiments of a circuit arrangement according to the invention.

FIG. 11 shows examples of integration over an oscillation period according to the invention for three oscillation periods, labelled with N, N+1 and N+2 for such a Buck-Boost arrangement. FIG. 7. shows three examples of current levels and integration results for a normal Buck-Boost converter. The curves cREF show curves of a reference current with a reference current level representative of the mean LED current level. The curves cL1 show curves of an integration current, the integration current being representative of the LED current. The levels Ipeak and Izero show indications of the crossover signal levels during the different oscillation periods, i.e. the peak current level and the valley current level respectively.

The curves cINTREF show a progression of the integration of the reference current over each respective oscillation period, resulting in a reference current integral INTREF at the end of the periods. The start points for the integration of the reference current are determined from a crossover of the Izero level by the integration current. The end points are determined from the next crossover in the same direction of the Izero level by the integration current.

The curves cINTL1 show a progression of the integration of the converter current over the corresponding oscillation periods, each resulting in an actual current integral at the end of the periods INTACT. As the converter current is only feeding the LED circuit during a part of the oscillation cycle, denoted with the pLBB and pLBBC phases in FIGS. 10*b* and 10*c*, the integration of the converter current should be limited to these parts only, to be equivalent to integrate the LED current in stead of the full converter current. The start points for the integration of the converter current are e.g. determined from detecting the negative slope of the switching control voltage VSW, detecting whether the LED current actually becomes non-zero (e.g. by detecting whether the diode D2 conducts a current or not), or any other suitable method. The end points are the same as for the reference current.

In an alternative embodiment, a LED current sensor is provided and arranged for establishing a LED current sensing voltage representative of the current level of the LED current ILED. Integration of the LED current may then be performed over the full oscillation cycle, as the LED current is zero during the phases in which the converter current is not fed to the LED circuit arrangement, i.e. during the phases denoted with pHBN and pHBBC in FIGS. 10*b* and 10*c*.

In oscillation period N, the conversion current shows quite some overshoot above the peak current level and also some undershoot below the valley current level. At the end of the oscillation period, the actual current integral is larger than the reference current integral. As a result, the peak current level is reduced for the next oscillation period N+1. The new trip voltage level associated with the new peak current level can be expressed as:

$$VH(N+1)=VH(N)+2*(\text{INTREF}-\text{INTACT})/(T(N));$$

$$VL(N+1)=VL(N)=0,$$

where the part of the oscillation cycle feeding during which the LED circuit arrangement is fed with the converter current has a relative duration denoted with a duty cycle being smaller than 100%.

In oscillation period N+1, the conversion current shows some overshoot above the peak current level and quite some undershoot below the valley current level. At the end of the oscillation period, the actual current integral is smaller than the reference current integral. As a result, the peak current level is increased for the next oscillation period N+2.

When the method is well-tuned and the integrations are done sufficiently accurate, the method generally converges within one or two conversion cycles, in contrast to classical feed-back systems requiring typically ten cycles or more.

Figure 12A:
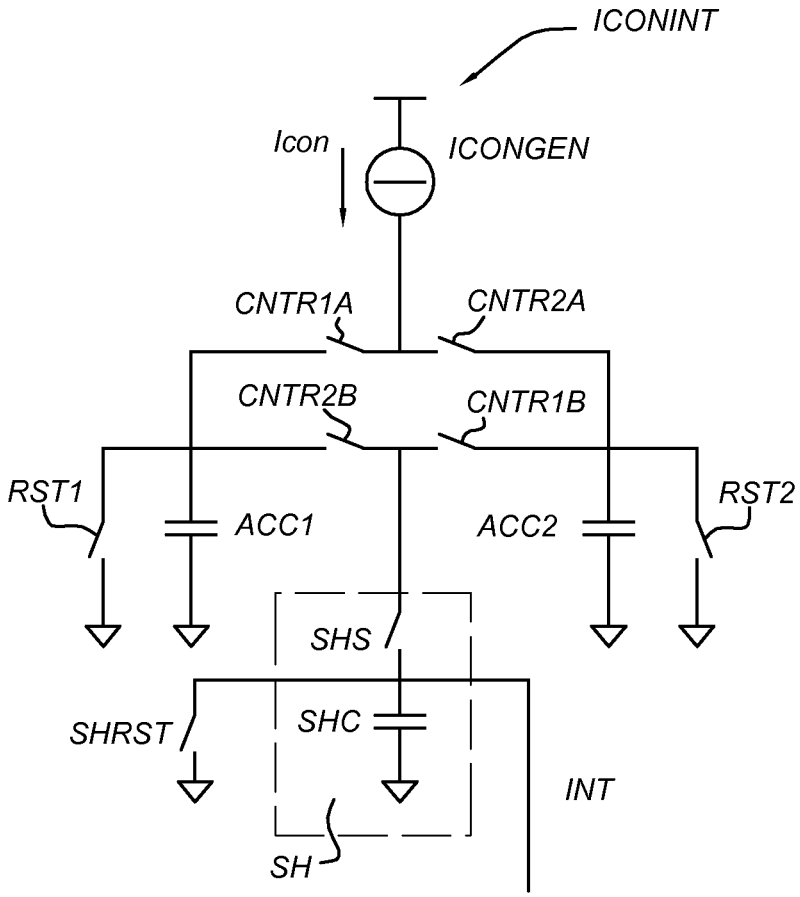
FIGS. 12*a* and 12*b* shows an exemplary embodiment of a double accumulator usable in embodiments of a circuit arrangement according to the invention and its method of operation.
Figure 12B:
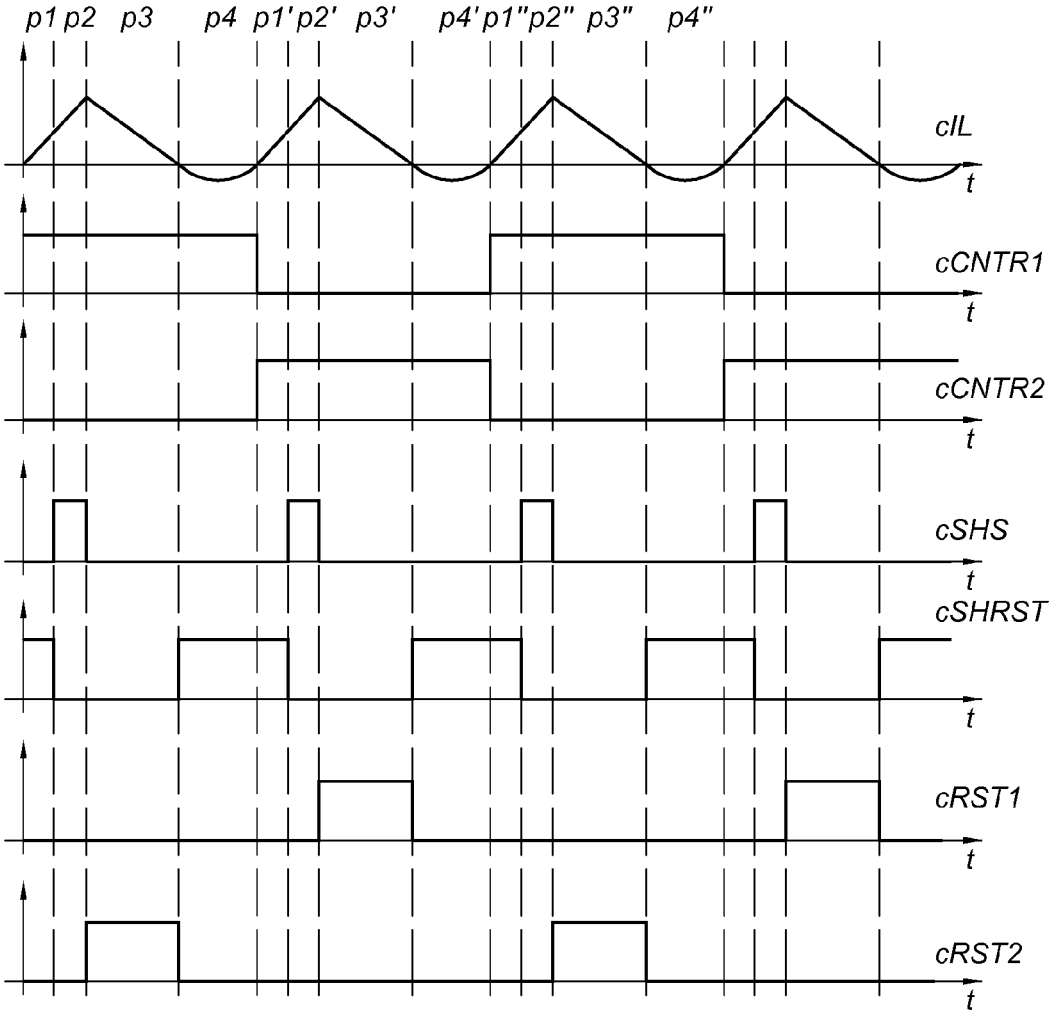

FIGS. 12*a* and 12*b* shows an exemplary embodiment of an integration circuit using a double accumulator for use in the circuit arrangement and its method of operation.

The integration circuit can be used for any of the integrations used with the invention, but will be described for integrating the constant current for obtaining the time duration of the oscillation cycle. The exemplary description will relate to a boundary-conduction mode converter, but the integration circuit may also be used with any other type of switch-mode converter according to the invention.

FIG. 12*a* shows the integration circuit. A current source ICONGEN generates the constant current Icon. The circuit comprises a first accumulator ACC1 in the form of a capacitor with a first reset switch RST1 and a second accumulator ACC2 in the form of another capacitor with a second reset switch RST2. The reset switches are used to discharge the capacitors to ground prior to starting the accumulation of the current, i.e. the start moment of integration. Control switches CNTR1A and CNTR2A connect the current source to the first and second accumulator respectively when the switches CNTR1A and CNTR2A are closed (conducting). Control switches CNTR1B and CNTR2B connect the first and second accumulator respectively to a sample-and-hold circuit SH when the switches CNTR1B,CNTR2B are closed (conducting). The sample-and-hold circuit SH comprises a hold element in the form of a sample-and-hold capacitor SHC, which may be reset using a hold reset switch SHRST to ground and may be loaded to sample the integration result INT with a sample switch SHS. The integration result INT is then available from the sample-and-hold circuit SH.

FIG. 12*b* shows a timing diagram for operation of the integration circuit. The top curve shows the converter current for a boundary conduction mode converter. The second curve, labelled with cCNTR1, shows a logical level versus time for controlling the switches CNTR1A and CNTR1B. A high level corresponds to the switch being closed (conducting), a low level corresponds to the switch being open. (non-conducting). Likewise, the curve labelled with cCNTR2 shows a logical level versus time for controlling the switches CNTR2A and CNTR2B, cSHS shows the control signal for the sample switch SHS, cSHRST shows the control signal for the hold reset switch SHRST, cRST1 shows the control signal for the reset switch RST1 and cRST2 shows the control signal for the reset switch RST2.

During phase p1-p4, switches CNTR1A, CNTR1B and RST1 are operated to accumulate the constant current on the first accumulator ACC1. At the same time, the second accumulator is coupled to the sample-and-hold circuit SH with switch CNTR2B. During phase p1, the hold reset switch SHRST is operated to reset the sample-and-hold capacitor SHC. During phase p2, the sample switch SHS is operated to sample the integration result INT from the second accumulator and store it on the sample-and-hold capacitor SHC.

During phase p3, the second accumulator is subsequently reset using the second switch RST2. During phase p4, the sample-and-hold capacitor is reset using the hold reset switch SHRST.

In phase p1', the first and second accumulator change role: switches CNTR2A, CNTR2B and RST2 are operated to accumulate the constant current on the second accumulator ACC2. At the same time, the first accumulator is coupled to the sample-and-hold circuit SH with switch CNTR1B. During phase p1', the hold reset switch SHRST is again operated to reset the sample-and-hold capacitor SHC. During phase p2', the sample switch SHS is operated to sample the integration result INT from the first accumulator and store it on the sample-and-hold capacitor SHC. During phase p3', the first accumulator is subsequently reset using the first switch RST1. During phase p4', the sample-and-hold capacitor is reset using the hold reset switch SHRST.

This way, then accumulation of the constant current on the first and second accumulator ACC1, ACC2, and the sampling on the sample-and-hold capacitor SHC is always performed on a capacitor which is fully discharged as a significant amount of time is associated with its reset.

Figure 13A:
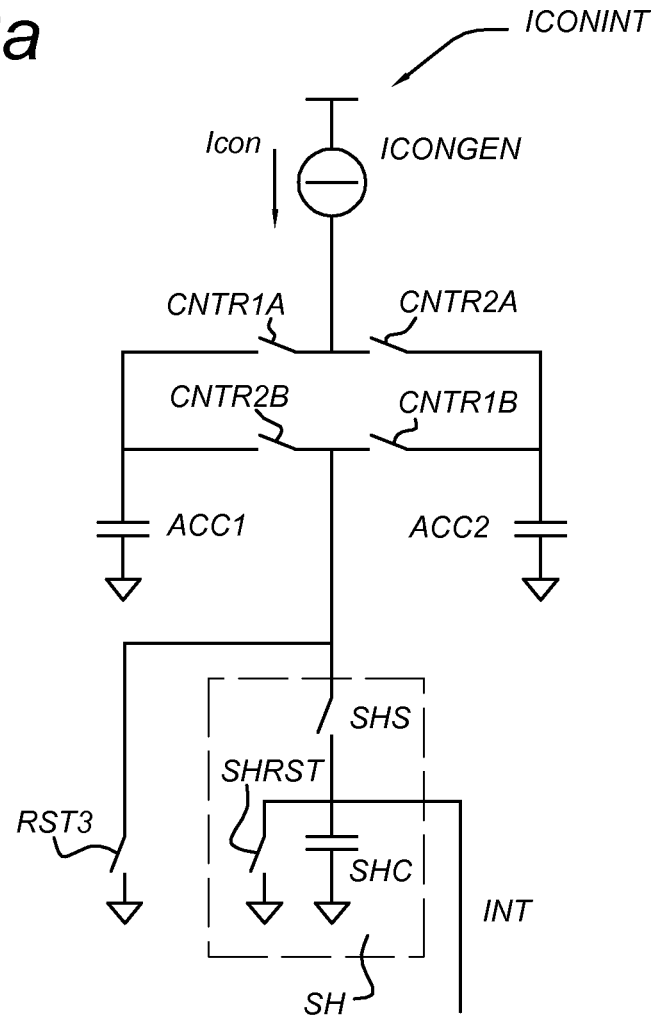
FIGS. 13*a* and 13*b* shows another exemplary embodiment of a double accumulator its method of operation.
Figure 13B:
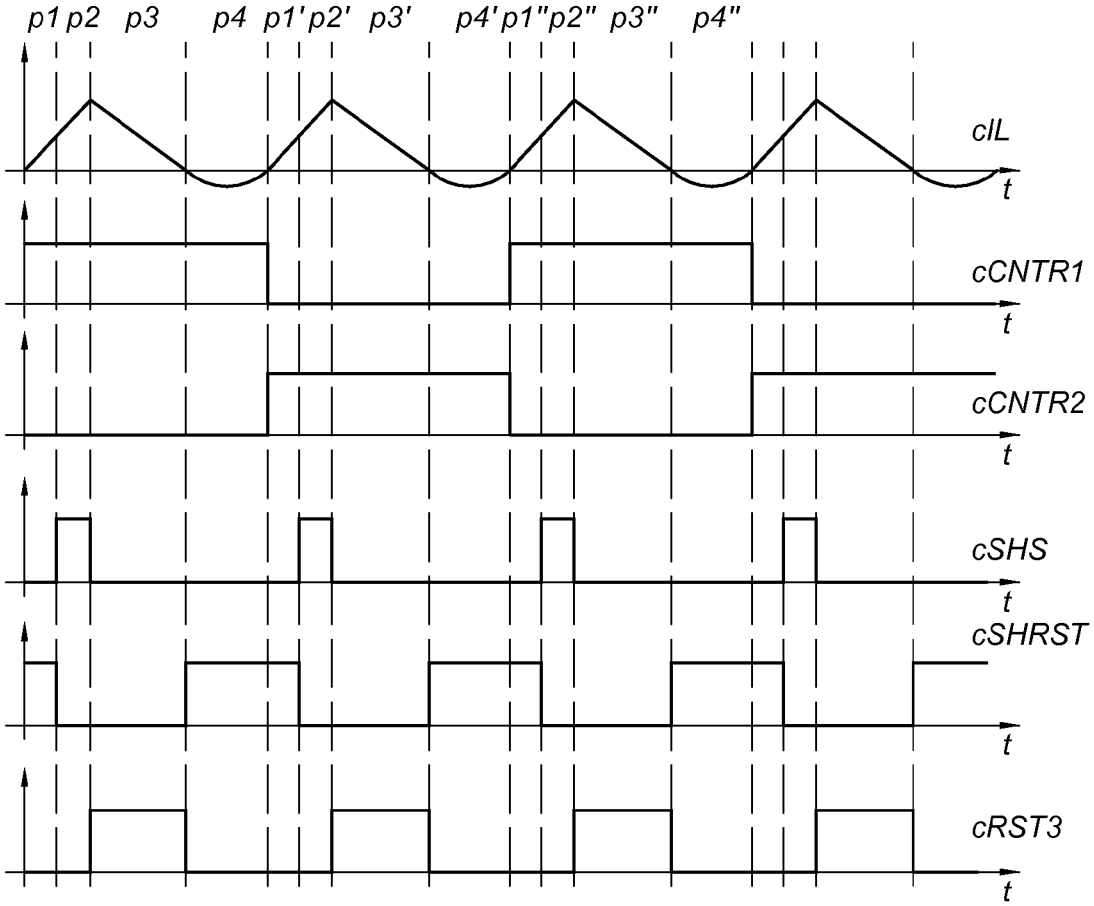

FIGS. 13*a* and 13*b* shows another exemplary embodiment of an integration circuit using a double accumulator for use in the circuit arrangement and its method of operation. The circuit and timing diagram are very similar to those described in reference with FIGS. 12*a* and 12*b*, and the description will not be repeated here.

In the integration circuit of FIG. 13*a*, the function of first reset circuit RST1 and the second reset circuit RST2 are implemented using a common reset switch RST3. The common reset switch RST3 cooperates with the control switches CNTR2B and CNTR1B to reset the first accumulator ACC1 and second accumulator ACC2 respectively in the respective phases p3' and p3. In phase p3', the first accumulator ACC1 is discharging to ground via switch CNTR2B and RST3. In phase p3, the second accumulator ACC2 is discharging to ground via switch CNTR1B and RST3.

Again, accumulation is performed alternating on the first accumulator ACC1 and second accumulator ACC2.

Figure 14A:
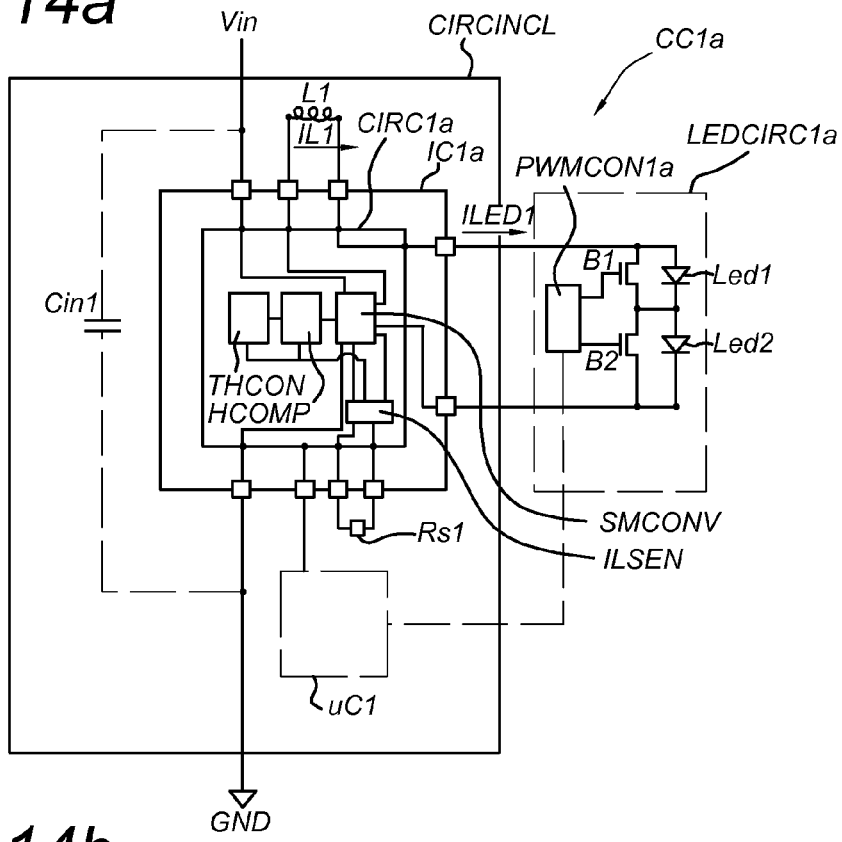
FIG. 14*a* shows a circuit composition comprising a LED driver IC and a LED circuit arrangement according to the invention.

FIG. 14*a* schematically shows a circuit composition CC1*a* comprising a LED driver IC IC1*a* and a LED circuit arrangement LEDCIRC1*a*. The LED driver IC IC1*a* is electrically connected to a LED circuit arrangement LEDCIRC1*a*. The LED circuit arrangement LEDCIRC1*a* may be a LED circuit arrangement CIRC1*a* like the one described in reference with FIG. 10, but may also be another LED arrangement suitable to be driven by the LED driver IC IC1*a*. The LED driver IC IC1*a* comprises an embodiment of a circuit arrangement CIRC according to the invention, comprising a switch-mode converter SMCONV, a hysteretic comparator HCOMP, a converter current sensor ILSEN and a threshold controller THCON.

The LED driver IC IC1 is connected between a ground voltage GND and an input voltage Vin. The input voltage Vin is delivered by a power supply (not shown), e.g. a DC power supply delivering a supply voltage of 24 V.

In the example shown, a capacitor Cin1 is placed over the LED driver IC IC1*a* to act as a capacitive input filter on the power supply voltage Vin.

In the example shown, the LED driver IC IC1*a* and the switch-mode converter SMCONV in the circuit arrangement CIRC1*a* are in electrical communication with an inductor L1 which is a discrete component external to the LED driver IC IC1*a*. The inductor L1 is in electrical communication with the LED circuit arrangement LEDCIRC1*a* via a connection internal in the LED driver IC IC1.

In the example shown, the LED driver IC IC1*a* and converter current sensor ILSEN in the circuit arrangement CIRC1*a* are in electrical communication with a resistor RS1 which is a discrete component external to the LED driver IC IC1*a*. A programmable processor uC1, such as a microprocessor, a FPGA, a DSP or any other programmable unit may optionally be connected, as shown by a dashed line, to the LED driver IC IC1*a*. The processor uC1 may alternatively or additionally be connected to a LED segment controller PWMCON1 in the LED circuit arrangement LEDCIRC1*a*, as shown by a further dashed line.

A computer program product arranged to perform elements of any one of the methods implemented as described above, may be loaded in the programmable processor, e.g., via an interface connection connectable, directly or via intermediate units, to the programmable processor or to a memory in communication with or included in the programmable processor. The computer program product may be read from a computer-readable medium, e.g., a solid state memory such as a flash memory, EEPROM, RAM, an optical disk loaded in an optical disk drive, a hard disk drive (HDD), or any other computer-readable medium. The computer-readable medium may be read by a dedicated unit, such as the optical disk drive to read the optical disk, directly by the programmable processor, such as a EEPROM connected to the programmable processor, or via other intermediate units.

The programmable processor uC1 may, e.g. comprise a colour control algorithm to keep a selected colour balance between the light output of the plurality of LEDs.

The programmable processor uC1 may, e.g. cooperate with a LED segment controller PWMCON in the LED circuit arrangement to define the pulse width modulation signals.

The programmable processor uC1 may be connected to the LED driver IC IC1 as shown in FIG. 14*a*. Alternatively, the programmable processor uC1 may be comprised in the LED driver IC IC1.

The programmable processor uC1 may, e.g. be comprised in the threshold controller THCON, to, e.g. determine the trip control voltage values in a computer program product. E.g., the programmable processor uC1 may be arranged to retrieve the status of bypass switches B1, B2 arranged for controlling the path of the current ILED1 through a first LED Led1 and a second LED Led2 in the LED circuit arrangement LEDCIRC1*a*.

The Figure also indicates a further circuit arrangement CIRCINCL which can be classified as a circuit arrangement according to the invention. The further circuit arrangement CIRCINCL comprises the LED driver IC IC1*a*, the optional programmable processor uC1, the inductor L1, the resistor RS1 and the optional capacitor Cin1.

The LED driver IC IC1*a* thus provides an integrated circuit which includes the circuit to regulate the mean current level and the period of the converter current IL1.

Figure 14B:
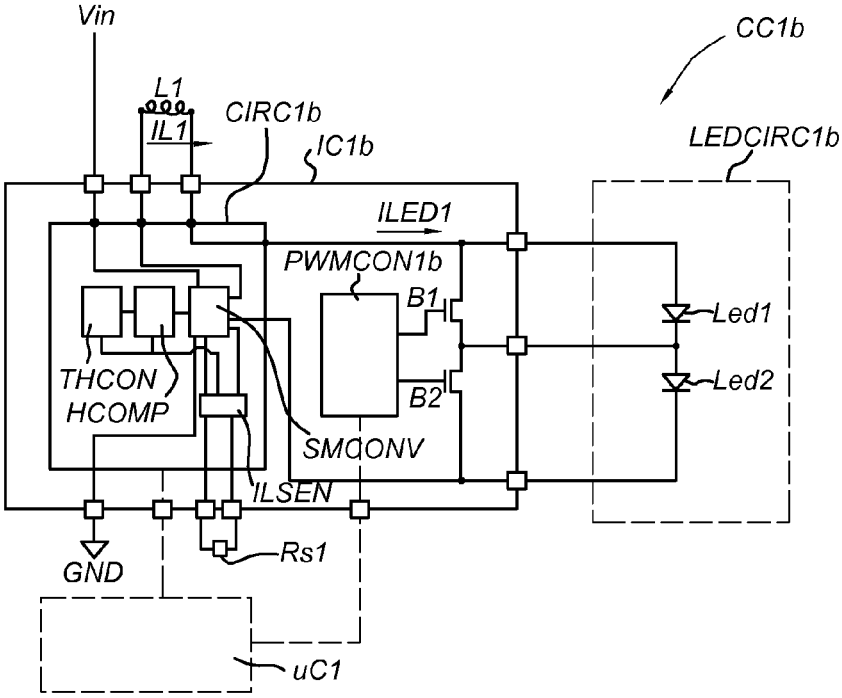
FIG. 14*b* shows another circuit composition comprising a LED driver IC and a LED circuit arrangement according to the invention.

FIG. 14*b* schematically shows a circuit composition CC1*a* comprising a LED driver IC IC1*b* and a LED circuit arrangement LEDCIRC1*b*. The LED driver IC IC1*b* is electrically connected to a LED circuit arrangement LEDCIRC1*b*. The LED circuit arrangement LEDCIRC1*b* as shown in FIG. 14*b* comprises a series arrangement of a first LED Led1 and a second LED Led2. The LED driver IC IC1*b* comprises an embodiment of a circuit arrangement like described above, comprising a switch-mode converter SMCONV, a hysteretic comparator HCOMP, a converter current sensor ILSEN, a threshold controller THCON, and also comprises a LED segment controller PWMCON1*b* and two bypass switches B1, B2. The LED segment controller PWMCON1*b* is operable to control two bypass switches B1, B2. The bypass switch B1 is connected parallel to the first LED Led1. The bypass switch B2 is connected parallel to the second LED Led2.

The LED driver IC IC1 is connected between a ground voltage GND and an input voltage Vin. The input voltage Vin is delivered by a power supply (not shown), e.g. a DC power supply delivering a supply voltage of 24 V.

In the example shown, the LED driver IC IC1*a* and the switch-mode converter SMCONV in the circuit arrangement CIRC1*a* are in electrical communication with an inductor L1 which is a discrete component external to the LED driver IC IC1*a*. The inductor L1 is in electrical communication with the LED circuit arrangement LEDCIRC1*a* via a connection internal in the LED driver IC IC1.

In the example shown, the LED driver IC IC1*b* and the converter current sensor ILSEN in the circuit arrangement CIRC1*a* are in electrical communication with a resistor RS1 which is a discrete component external to the LED driver IC IC1*b*.

A programmable processor uC1, such as a microprocessor, a FPGA, a DSP or any other programmable unit may optionally be connected, as shown by a dashed line, to the LED driver IC IC1*b*. The processor uC1 communicate with the LED segment controller PWMCON1*b* in the LED driver IC IC1*b*, as shown by a further dashed line.

The LED driver IC IC1*b* thus provides an integrated circuit which includes both the circuit to regulate the mean current level of the LED current ILED1, and the circuit for operating the LEDs with pulse width modulation. Such an integrated circuit may be appreciated for high-volume applications, as it may provide a cost-effective system.

Figures 15, 16:
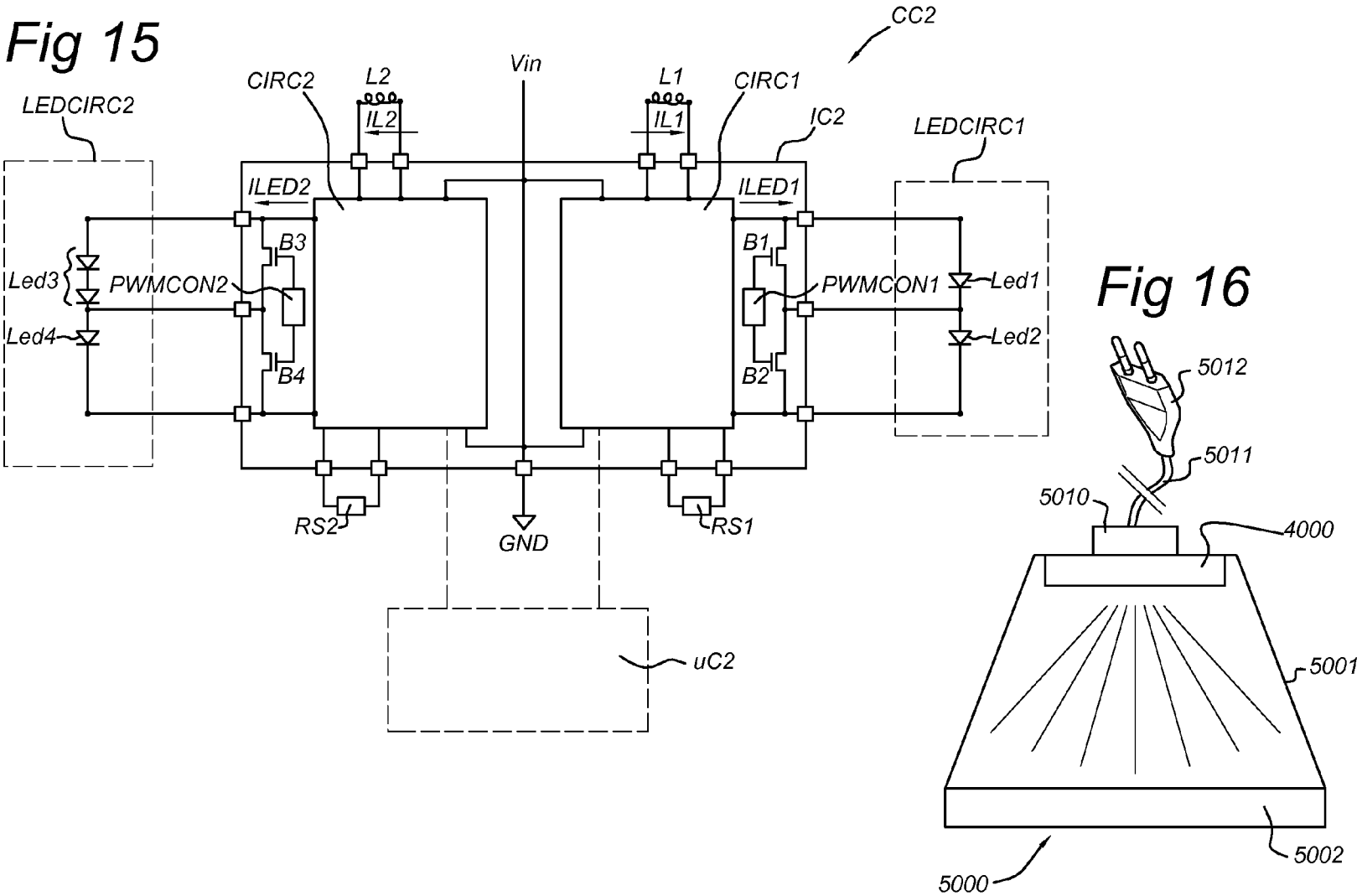
FIG. 15 shows an alternative circuit composition comprising a LED driver IC and a LED circuit arrangement according to the invention.
FIG. 16 shows an embodiment of a LED lighting system according to the invention.

FIG. 15 schematically shows a circuit composition CC2 comprising a LED driver IC IC2, a first LED circuit arrangement LEDCIRC1 and a second LED circuit arrangement LEDCIRC2. The LED driver IC2 is electrically connected to the first LED circuit arrangement LEDCIRC1 and to the second LED circuit arrangement LEDCIRC2.

The first LED circuit arrangement LEDCIRC1 may, e.g. be a LED circuit arrangement comprising a green LED Led1 and a blue LED Led2 in series. The second LED circuit arrangement LEDCIRC2 may, e.g. be a LED circuit arrangement comprising a LED segment Led3 comprising two red LEDs and an amber LED Led4 in series.

The LED driver IC2 comprises a first circuit arrangement CIRC1 according to the invention and a second circuit arrangement CIRC2 according to the invention, to respectively regulate a first LED current ILED1 flowing through the first LED circuit arrangement LEDCIRC1 and regulate a second LED current ILED2 flowing through the second LED circuit arrangement LEDCIRC2.

The first circuit arrangement CIRC1 and the first LED circuit arrangement LEDCIRC1 are, during use, in electrical communication with a first inductor L1 and a first resistor Rs1, the first inductor L1 and the first resistor Rs1 being external to the IC. The second circuit arrangement CIRC2 and the second LED circuit arrangement LEDCIRC2 are, during use, in electrical communication with a second inductor L1 and a second resistor Rs2, the second inductor L1 and the second resistor Rs2 also being external to the IC.

The LED driver IC IC2 further comprises a first LED segment controller PWMCON1 operable to control two bypass switches B1, B2, also integrated in the IC. The two bypass switches B1, B2 are operable to select the path of the first LED current ILED1 through the first LED circuit arrangement LEDCIRC1 and are associated with the green LED Led1 and the blue LED Led2. The bypass switch B1 is connected parallel to the green LED Led1. The bypass switch B2 is connected parallel to the blue LED Led2.

The LED driver IC IC2 further comprises a second LED segment controller PWMCON2 operable to control a further two bypass switches B3, B4, also integrated in the IC. The two bypass switches B3, B4 are operable to select the path of the second LED current ILED2 through the second LED circuit arrangement LEDCIRC2 and are associated with the two red LEDs Led3, and the amber LED Led4. The bypass switch B3 is connected parallel to the LED segment Led3, i.e. to the series arrangement of the two red LEDs. The bypass switch B4 is connected parallel to the amber LED Led4.

The first LED segment controller PWMCON1 and the second LED segment controller PWMCON2 may operate each using an individual clock as a reference for the pulse width modulation resolution, but may alternatively be operated from a common clock. When using individual clocks, the clock period associated with the clock may be substantially the same or substantially different. In an embodiment, the clock generator of the second LED segment controller PWMCON2 behaves as a slave to the first LED segment controller PWMCON1, and the clock of the second LED segment controller PWMCON2 is derived from the clock of the first LED segment controller PWMCON1. The clocks may be generated in the LED driver IC itself, or be provided externally, e.g. by an externally mounted crystal oscillator. The pulse width period may be substantially the same for the first LED segment controller PWMCON1 and the second LED segment controller PWMCON2, but may alternatively be different.

The LED driver IC IC2 is connected between a ground voltage GND and an input voltage Vin. The input voltage Vin is delivered by a power supply (not shown), e.g. a DC power supply delivering a supply voltage of 24 V.

The LED driver IC IC2 may be further connected to a programmable processor uC2. The programmable processor uC2 may be of similar nature and perform similar functions as the programmable processor uC1 described in reference with FIG. 14*a*.

The LED driver IC IC2 thus provides an integrated circuit which includes both the circuit to regulate the mean LED current level of the LED current and the circuit for operating the LEDs with pulse width modulation, for a lighting system comprising four LED colours. The effective light output of each of the four LED colours can be controlled individually. Hence, a cost-effective lighting system with a high degree of colour control and intensity control may be constructed by employing such an integrated circuit.

FIG. 16 shows an example of a light source 5000 with a LED assembly 4000 in a housing 5001. The housing 5001 is a box with, preferably, reflective inner walls. The LED assembly 4000 comprises one or more LEDs and a circuit arrangement employing, during use, one of the methods implemented as described above. The light generated by the LED assembly 4000 is reflected towards the front of the housing 5001, which is covered with a diffusive transparent plate 5002. The light source 5000 carries a power adapter 5010, which supplies the LED assembly 4000 from a power converter, connected to the mains via a power cord 5011 with a power connecter 5012, to fit a wall contact (not shown) with mains supply.

It should be noted that the above-mentioned embodiments illustrate rather than limit the invention, and that those skilled in the art will be able to design many alternative embodiments without departing from the scope of the appended claims. E.g., the LED circuit arrangement may comprise more than two segments, each being controllable with a respective switch, or the LED circuit arrangement may comprise a further LED segment which is not controllable with a switch, without departing from the scope of the invention and the appended claims. Likewise, the invention may apply to alternative switch-mode converter topologies not mentioned explicitly in the text. In the claims, any reference signs placed between parentheses shall not be construed as limiting the claim.

The invention claimed is:

1. A method for cycle-by-cycle control of a LED current flowing through a LED circuit arrangement at a mean LED current level, the method comprising:

establishing a converter current;

establishing an oscillation of the converter current between substantially a valley current level and substantially a peak current level;

feeding the LED circuit arrangement with the converter current as the LED current during a part of an oscillation cycle of the oscillation of the converter current;

determining a current level correction for compensating a current level error between an integral over an oscillation cycle of the LED current and a reference, the reference being representative of the mean LED current level; and adjusting at least one of the valley current level and the peak current level with the current level correction for use in a successive cycle of the oscillation of the converter current.

2. A circuit arrangement for cycle-by-cycle control of a LED current flowing through a LED circuit arrangement at a mean LED current level, the circuit arrangement comprising:

converter current establishing means for establishing a converter current;

oscillation means for establishing an oscillation of the converter current between substantially a valley current level and substantially a peak current level;

feeding means for feeding the LED circuit arrangement with the converter current as the LED current during a part of an oscillation cycle of the oscillation of the converter current;

determining means for determining a current level correction for compensating a current level error between an integral over an oscillation cycle of the LED current and a reference, the reference being representative of the mean LED current level; and adjusting means for adjusting at least one of the valley current level and the peak current level with the current level correction for use in a successive cycle of the oscillation of the converter current.

3. The circuit arrangement according to claim 2, wherein:

for establishing the oscillation of the converter current, the circuit arrangement comprises:

a converter current sensor operable to establish a converter current sensing signal representative of the current level of the converter current flowing in the circuit arrangement, a hysteretic comparator operable to establish an upper trip signal and a lower trip signal as control crossover thresholds, the upper trip signal being associated with the peak current level of the converter current and the lower trip signal being associated with the valley current level of the converter current, the hysteretic comparator being in electrical communication with the converter current sensor to receive the converter current sensing signal), wherein the hysteretic comparator is operable to output a switching control signal at a first logic level in response to a crossover of the lower trip signal by the converter current sensing signal, and wherein the hysteretic comparator is operable to output the switching control signal at a second logic level in response to a crossover of the upper trip signal by the converter current sensing signal, and a switch-mode converter operable to control a flow of the converter current through the circuit arrangement, the switch-mode converter being in electrical communication with the hysteretic comparator to receive the switching control signal, wherein the switch-mode converter controls an increase of the converter current from the valley current level to the peak current level in response to the switching control signal equalling the first logic level, and wherein the switch-mode converter controls a decrease of the converter current from the peak current level to the valley current level in response to the switching control signal equalling the second logic level;

for determining the current level correction for compensating the current level error between the integral over the oscillation cycle of the LED current and the reference, the circuit arrangement comprises:

a correction calculator operable for determining the current level correction, the correction calculator being in electrical communication with the converter current sensor to receive the converter current sensing signal;

for adjusting at least one of the valley current level and the peak current level with the current level correction for use in a next cycle of the oscillation of the converter current, the circuit arrangement comprises:

a threshold controller operable for adjusting at least one of the upper trip signal and the lower trip signal, corresponding with adjusting the valley current level and the peak current level respectively, the threshold controller being in electrical communication with the correction calculator for receiving the current level correction and in electrical communication with the hysteretic comparator for delivering, after adjusting, the upper trip signal and the lower trip signal respectively.

4. The circuit arrangement according to claim 3, wherein the correction calculator comprises:

an integration current establisher operable for establishing an integration current, the integration current being representative of the LED current, the integration current establisher being in electrical communication with the converter current sensor for receiving the converter current sensing signal;

a first current integrator operable for obtaining an actual current integral from:

receiving the integration current from the integration current establisher, and integrating the integration current over the part of the oscillation cycle as the actual current integral;

a reference current establisher operable for establishing a reference current with a reference current level representative of the mean LED current level; and a second current integrator operable for obtaining a reference current integral from:

receiving the reference current from the reference current establisher, and integrating the reference current over the oscillation cycle as the reference current integral;

and wherein the correction calculator is operable for determining the current level correction from at least the actual current integral and the reference current integral.

5. The circuit arrangement according to claim 4, wherein the correction calculator is operable for determining a multiplicative correction factor from dividing the reference current integral by at least the actual current integral, and the threshold controller is operable for adjusting at least one of the valley current level and the peak current level by multiplying with the multiplicative correction factor.

6. The circuit arrangement according to claim 4, wherein: the correction calculator is operable for determining an additive correction term from:

obtaining a difference of the reference current integral and the actual current integral by subtracting the actual current integral from the reference current integral, and dividing the difference by at least a time duration of the oscillation cycle, and the threshold controller is operable for adjusting at least one of the valley current level and the peak current level by adding the additive correction term.

7. The circuit arrangement according to claim 6, further comprising:

a constant current establisher operable for establishing a constant current with a constant current level;

a constant current integrator (ICONINT) operable for obtaining the time duration of the oscillation cycle from: receiving the constant current, integrating the constant current over the part of the oscillation cycle as an integrated constant current, and normalizing the integrated constant current with the constant current level.

8. The circuit arrangement according to claim 3, wherein the correction calculator comprises:

a reference current establisher operable for establishing a reference current with a reference current level representative of the mean LED current level;

an integration current establisher operable for establishing an integration current, the integration current being representative of the LED current, the integration current establisher being in electrical communication with the converter current sensor for receiving the converter current sensing signal; and wherein the correction calculator is operable for:

receiving the reference current from the reference current establisher;

receiving the integration current from the integration current establisher;

obtaining a current difference of the integration current and the reference current by subtracting the integration current from the reference current during the oscillation cycle;

integrating the current difference over the oscillation cycle to obtain the current level error; and determining the current level correction from at least the current level error.

9. The circuit arrangement according to claim 8, wherein: the correction calculator is operable for determining an additive correction term from dividing the current level error by at least a time duration of the oscillation cycle and the threshold controller is operable for adjusting at least one of the valley current level and the peak current level by adding the additive correction term.

10. The circuit arrangement according to claim 3, wherein the switch-mode converter comprises:

a switch in electrical communication with the hysteretic comparator to be opened and closed as a function of the switching control signal, a component selected from the group including a diode and a second switch, the second switch being in electrical communication with the hysteretic comparator to be closed and opened as a function of the switching control signal, the component being in electrical communication with the switch via an output node, the output node being, during use, in electrical communication with the LED circuit arrangement, and the switch being arranged for charging and discharging an inductive output filter, the inductive output filter being, during use, in electrical communication with the LED circuit arrangement.

11. The circuit arrangement according to claim 2, wherein, for integrating a specific current for obtaining a specific current integral over a fraction of the oscillation cycle, the circuit arrangement comprises:

a first reset circuit operable for:

resetting a first accumulator;

the first accumulator being operable for:

accumulating an integration current representative of the specific current over the fraction of the oscillation cycle on the first accumulator as a first accumulated integration current, and for providing the first accumulated integration current from the first accumulator as the specific current integral after the fraction of the oscillation cycle has lapsed.

12. The circuit arrangement according to claim 11, further comprising:

a second reset circuit operable for:

resetting a second accumulator while the integration current is accumulated on the first accumulator in a first oscillation cycle;

the second accumulator being operable for:

accumulating the integration current representative of the specific current over the fraction of the oscillation cycle in a second oscillation cycle on the second accumulator as a second accumulated integration current, the second oscillation cycle being successive to the first oscillation cycle, while the first accumulator is providing the accumulated integration current from the first accumulator as the specific current integral, and providing the second accumulated integration current as the specific current integral after the fraction of the second oscillation cycle has lapsed.

13. The circuit arrangement according to claim 12, wherein the first reset circuit and the second reset circuit are implemented with at least a common reset switch.

14. The circuit arrangement according to claim 2, further comprising:

a LED segment controller in electrical communication with the LED circuit arrangement, and wherein the LED circuit arrangement comprises a first LED segment, a first switching element electrically parallel to the first LED segment, at least a second LED segment, a second switching element electrically parallel to the second LED segment, the first and second switching elements being operable by the LED segment controller to select the path of the LED current to pass through the LED segment associated with the respective switching element or to bypass the LED segment associated with the respective switching element.

15. A LED driver IC comprising a first circuit arrangement according to claim 2, associated, during use, with a first LED circuit arrangement.

16. A LED driver IC according to claim 15, further comprising a second circuit arrangement including:

converter current establishing means for establishing a converter current;

oscillation means for establishing an oscillation of the converter current between substantially a valley current level and substantially a peak current level;

feeding means for feeding the LED circuit arrangement with the converter current as the LED current during a part of an oscillation cycle of the oscillation of the converter current;

determining means for determining a current level correction for compensating a current level error between an integral over an oscillation cycle of the LED current and a reference, the reference being representative of the mean LED current level; and adjusting means for adjusting at least one of the valley current level and the peak current level with the current level correction for use in a successive cycle of the oscillation of the converter current, associated, during use, with a second LED circuit arrangement.

17. A circuit composition comprising:

a circuit arrangement in accordance with claim 2, and a LED circuit arrangement comprising at least one LED, wherein the circuit arrangement is in electrical communication with the LED circuit arrangement for feeding the converter current to the LED circuit arrangement during the part of the oscillation cycle of the oscillation of the converter current.

18. A LED lighting system comprising a circuit arrangement according to claim 2.

* * * * *